US011148455B2

(12) United States Patent
Epstein et al.

(10) Patent No.: US 11,148,455 B2
(45) Date of Patent: Oct. 19, 2021

(54) MODULAR NOTEBOOK SYSTEM

(71) Applicant: Rocket Innovations, Inc., Boston, MA (US)

(72) Inventors: Jacob Epstein, Wakefield, MA (US); Joseph Lemay, Marblehead, MA (US)

(73) Assignee: Rocket Innovations, Inc., Boston, MA (US)

( * ) Notice: Subject to any disclaimer, the term of this patent is extended or adjusted under 35 U.S.C. 154(b) by 0 days.

(21) Appl. No.: 16/906,666

(22) Filed: Jun. 19, 2020

(65) Prior Publication Data

US 2020/0398602 A1 Dec. 24, 2020

Related U.S. Application Data

(60) Provisional application No. 62/863,518, filed on Jun. 19, 2019, provisional application No. 62/950,726, filed on Dec. 19, 2019.

(51) Int. Cl.

| | |
|---|---|
| ***B42D 13/00*** | (2006.01) |
| ***B42F 11/04*** | (2006.01) |
| ***B42F 9/00*** | (2006.01) |
| ***B42D 1/06*** | (2006.01) |
| ***B42F 1/00*** | (2006.01) |
| ***B42D 3/12*** | (2006.01) |

(52) U.S. Cl.

CPC ..... *B42D 1/06* (2013.01); *B42D 3/12* (2013.01); *B42D 13/00* (2013.01); *B42F 1/00* (2013.01); *B42F 9/00* (2013.01); *B42F 11/04* (2013.01)

(58) Field of Classification Search

CPC ..... B42F 13/00; B42F 11/04; B42F 9/00

USPC ..... 281/45–50, 19.1, 27.2, 27.3, 34; 248/441.1–465; 402/503, 75, 501

See application file for complete search history.

(56) References Cited

U.S. PATENT DOCUMENTS

| | | | | |
|---|---|---|---|---|
| 2,489,706 | A * | 11/1949 | Emmer | B42F 13/02 281/27.2 |
| 3,145,326 | A * | 8/1964 | Mcgannon | B42F 11/04 335/285 |
| 4,466,639 | A * | 8/1984 | Finnegan | B42F 11/04 281/45 |
| 4,588,209 | A | 5/1986 | Zebrowski et al. | |
| 5,433,480 | A | 7/1995 | Gresham et al. | |
| 5,575,503 | A | 11/1996 | Takahashi | |
| 2008/0273917 | A1 * | 11/2008 | Beuselinck | B42F 13/40 402/75 |

(Continued)

FOREIGN PATENT DOCUMENTS

| | | | | |
|---|---|---|---|---|
| CN | 208827389 | U | 5/2019 | |
| EP | 2687382 | A1 * | 1/2014 | B42F 23/00 |

(Continued)

OTHER PUBLICATIONS

International Search Report and Written Opinion for PCT/US2020/038695, dated Sep. 8, 2020 (42 pages).

*Primary Examiner* — Kyle R Grabowski

(74) *Attorney, Agent, or Firm* — Nutter McClennen & Fish LLP

(57) ABSTRACT

A modular notebook system includes a cover having a plurality of surfaces. The system also includes a binding coupled to the plurality of surfaces via a flexible and/or foldable material. The binding forms a magnetic spine by having at least one magnetic pad configured to receive a magnetically attractive binding element.

25 Claims, 24 Drawing Sheets

(56) References Cited

U.S. PATENT DOCUMENTS

| | | | | |
|---|---|---|---|---|
| 2009/0315313 | A1* | 12/2009 | Kalman | B42D 3/02 281/16 |
| 2014/0125047 | A1* | 5/2014 | Thibierge | B42D 3/02 281/27.3 |
| 2014/0186094 | A1 | 7/2014 | Lin | |
| 2015/0096157 | A1* | 4/2015 | Paulick | B42F 9/002 24/67 R |
| 2018/0154673 | A1* | 6/2018 | Good-Man | D21H 21/14 |
| 2020/0038695 | A1 | 2/2020 | Williams et al. | |

FOREIGN PATENT DOCUMENTS

| | | | | | |
|---|---|---|---|---|---|
| FR | 1045406 | A | * | 11/1953 | E04B 1/82 |
| FR | 2342855 | A1 | | 9/1977 | |
| GB | 617186 | A | * | 2/1949 | B42F 11/04 |
| JP | 01306294 | A | * | 12/1989 | |
| WO | 2007127451 | A2 | | 11/2007 | |
| WO | 2018/191727 | A1 | | 10/2018 | |

* cited by examiner

MODULAR NOTEBOOK SYSTEM

PRIORITY

This patent application claims priority from U.S. provisional patent application No. 62/863,518, filed Jun. 19, 2019, and U.S. provisional patent application No. 62/950,726, filed Dec. 19, 2019, each of which is incorporated herein by reference in their entirety.

FIELD OF THE INVENTION

Illustrative embodiments of the invention generally relate to writing surfaces and, more particularly, the illustrative embodiments of the invention relate to modular and/or configurable notebooks.

BACKGROUND OF THE INVENTION

Notes are frequently taken using classic pen and paper systems. Students, for example, generally purchase new notebooks every new school year for various subject matters, and/or when a notebook is filled up. Pages of notebooks may go unused, and thus, trees and other natural resources are wasted. Attempts have been made to migrate to other note taking formats, such as digital tablet devices and reusable writing surfaces. Many users prefer the feel of writing with a writing instrument on paper, and thus, do not adjust well to the feel of taking notes with digital devices. Furthermore, many classroom environments do not allow the use of electronic devices.

SUMMARY OF VARIOUS EMBODIMENTS

In accordance with one embodiment of the invention, a modular notebook system includes a cover having a plurality of surfaces. The system also includes a binding coupled to the plurality of surfaces via a flexible and/or foldable material. The binding forms a magnetic spine by having at least one magnetic pad configured to receive a magnetically attractive binding element.

The system may also include a magnetically attractive binding element configured to couple with a page pack. The magnetically attractive binding element may be deformable from a first substantially planar orientation to a second substantially cylindrical orientation. The binding element is coupled with the page pack as it transitions to the second substantially cylindrical orientation. The substantially cylindrical orientation may form a substantially closed cylinder, such that a seam in the cylinder is sufficiently small to mitigate pages from the page pack from accidentally being uncoupled from the binding element.

In some embodiments, the modular notebook system may include a plurality of magnetic pads. The cover may have an open configuration and a closed configuration. The notebook may be configured so that the surfaces of the cover and the binding lay substantially flat in the open configuration. Additionally, or alternatively, the notebook may be configured so that at least one of the surfaces of the cover and the binding lay substantially flat in the closed configuration.

In some embodiments, the system may include a page pack having an opening to receive the binding element. The pages in the page pack may be college ruled and/or graph paper. Additionally, the surfaces of the cover may be rigid.

The magnetic pad may have a contoured receiving surface. Additionally, or alternatively, the magnetic pad may have an outer wall. The magnetic pad may be recessed into the spine. Accordingly, the magnetic pad may be flush with the spine. Alternatively, the magnetic pad may protrude from the spine. The binding element may magnetically couple with the pad, and may be removed from the pad using a threshold amount of force.

In accordance with another embodiment, a modular note taking system includes a support surface configured to support a plurality of writing surfaces (e.g., pages). To that end, the system has at least one binding element configured to retain the plurality of writing surfaces. The system also has a pad coupled with the support surface. The pad has a retainment member configured to couple with the at least one binding element to removably secure the writing surfaces to the support surface.

In some embodiments the retainment member is a magnet, and the pad is a magnetic pad. Additionally, or alternatively, the retainment member may be a hook configured to be positioned within a barrel of the binding element. In some embodiments, the pad has a ramp on which the binding element is configured to slide. Additionally, the pad may have a bump against which the binding element rests.

In various embodiments, the support surface may be rigid. The support surface may be a clipboard, for example. The support surface may be part of a cover of a notebook. In various embodiments, the pad may be integral to the support surface, or, attached to the support surface via an adhesive. The pad may be oriented horizontally relative to a longitudinal axis of the page and/or the support surface.

In some embodiments, the binding element is metallic. The binding element may have a notch, and a notch receiving portion. The binding element may have a seam that forms a V-shape when the element is in a closed position. Furthermore, in some embodiments, coupling the at least one binding element and the pad is sufficiently strong to withstand the weight of the page pack without being dislodged from the pad.

In accordance with yet another embodiment, a magnetically coupled note taking system includes a support surface coupled with at least one magnet. The system includes a writing surface having a slot for receiving a magnetically attractive binding element. The system further includes a magnetically attractive binding element configured to couple with the slot to retain the writing surface.

Among other things, the support surface may include a pen dock. The slot may be an elongated slot. For example, the slot may have a length greater than 5 times the width of the slot. The slot may have a width of 3 mm.

The writing surface may be a synthetic page. The system may be configured to non-destructively uncouple the one or more binding elements from the one or more magnets with a pull force of between 3 lbs. and 10 lbs.

In accordance with yet another embodiment, a writing surface pack includes a plurality of writing surfaces configured to be written on with a writing instrument. The plurality of writing surfaces each have a turning edge and an elongated slot configured to receive a magnetically attractive binding element. The magnetically attractive binding element encompasses at least a portion of the turning edge. The pack also includes a magnetically attractive binding element configured to retain the plurality of writing surfaces by passing through the elongated slot and encompassing at least a portion of the turning edge.

In various embodiments, the writing surfaces form a page pack. In various embodiments, the writing surfaces come with pre-printed template, such as a dot-grid template. Each of the pages has an elongated slot. The elongated slot has a length of between about 10 mm and 120 mm. The elongated slot may have a length greater than 5 times the width of the elongated slot, and up to 100 times the width of the elongated slot.

In some embodiments, the writing surfaces each include two slots. A distance between the two slots may be between 20 mm and 80 mm. The elongated slots may have a width of about 3 mm. The binding element may have a thickness of less than 1 mm. Additionally, the binding element may have a thickness of between about 0.5 mm and 1.5 mm. The binding element may also have a length of between about 10 mm and 120 mm. Furthermore, the closed binding element may have a diameter of about 11 mm and/or a circumference of about 38 mm.

In some embodiments, the support surface is coupled with magnets configured to magnetically couple with the binding element. Furthermore, some embodiments include a magnetic pad. The magnetic pad may have a curved retaining surface and/or an outer wall. Furthermore, the retaining surface may have a radius of curvature configured to substantially match a radius of curvature of the binding element. Some embodiments may also include an alternative or additional metallic binding, such as a spiral binding or a ring binding.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

DESCRIPTION OF ILLUSTRATIVE EMBODIMENTS

In illustrative embodiments, a system includes a modular notebook cover and page binding element. The modular notebook may have a magnetic spine configured to receive a metallic and/or magnetically attractive page binding element. In turn, the page binding element may couple with a page or a pack of pages. Accordingly, users may swap various notebook covers with various page packs. This allows the user to reconfigure the notebook based on the task at hand. Furthermore, the order of pages in the notebook may adjusted. For example, the first page of the page pack may be rotated to become the last page in the page pack, and the page pack may be recoupled to the notebook. Details of illustrative embodiments are discussed below.

Paper notebooks continue to be a valuable tool in education, the workplace, art, and everyday life. There are thousands of choices for notebooks when one considers color, page patterns, quality, price, etc. For many people, different circumstances call for a different notebook. One person may want graph pages for math class and lined pages for English class. Another may want a thick journal-like notebook for a business meeting, but a slimmer notebook for traveling. Choosing a new notebook can be overwhelming when considering all of the potential circumstances, in addition to price.

On the other hand, it is challenging for notebook manufacturers to bulk manufacture the large number of permutations of notebooks to perfectly satisfy every customer. Illustrative embodiments advantageously allow users to configure a notebook as they see fit for their specific application.

Illustrative embodiments allow users to change from one style, page format, or even color depending on the day, meeting or class.

Notebook manufacturers advantageously benefit from illustrative embodiments of the modular notebook by selling a wide range of cover styles that may be mated to a wide range of page styles. Splitting these two components reduces the number of permutations needed to satisfy the market and allows greater price discrimination across markets.

Figure 1:
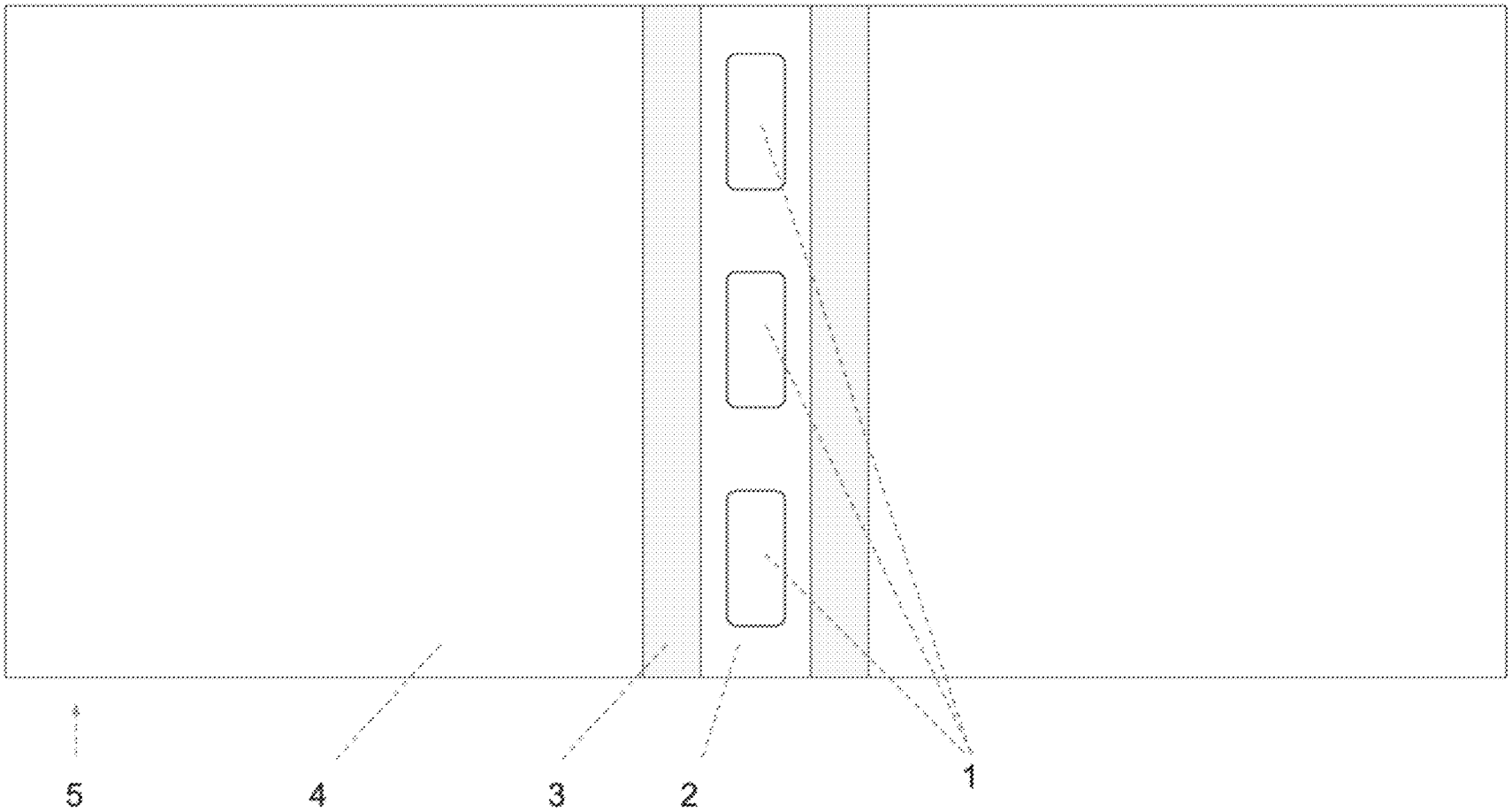
FIG. 1 schematically shows a front view of a modular notebook cover in an open configuration in accordance with illustrative embodiments of the invention.

FIG. 1 schematically shows a front view of a modular notebook cover 5 in an open configuration in accordance with illustrative embodiments of the invention. The open configuration means that the notebook cover 5 is open (e.g., as if resting on a table). From the top view, the inside of the cover 5 is visible. In some embodiments, the cover 5 may include two support surfaces 4 (referred to herein as rigid surfaces 4). However, in some embodiments, the surfaces 4 may be semi-rigid, such as a flexible leather material. Each of the surfaces 4 may be coupled with a spine 2 (e.g., via flexible material 3). As another example, the spine 2 may be molded into the rigid surface 4 and/or trapped between layers that form the rigid surface 4.

Although illustrative embodiments refer to a notebook and notebook cover 5, it should be understood that illustrative embodiments are not limited thereto. For example, as shown in later figures, illustrative embodiments may operate with a clipboard style notebook. Additionally, or alternatively, illustrative embodiments may operate with a variety of writing surfaces (e.g., index cards). Accordingly, discussion of notebooks and/or page packs is used as an example to facilitate discussion of illustrative embodiments and is not intended to limit various embodiments.

In illustrative embodiments, the spine 2 is a magnetic spine 2. Although referred to as a magnetic spine 2, it should be understood that illustrative embodiments do not require that the entirety of the spine 2 be magnetic. Instead, a portion or portions of the spine 2 may be magnetic. For example, the spine 2 may have at least one magnetic pad 1 that acts as a connection between the cover 5 and a page pack (not shown in FIG. 1). However, in some other embodiments, the spine 2 may not be magnetic (e.g., may use hooks to retain page packs). In some embodiments, the magnetic spine 2 may have no magnetic pads 1, and may merely comprise one or more magnets built into the rigid surface 4. The magnetic spine may be formed from, for example, polypropylene.

In some embodiments, the surfaces 4 may be coupled directly with the magnetic spine 2. In some other embodiments, a material 3, such as a flexible material 3, may be used to couple the surfaces 4 with the spine 2. In some other embodiments, the material 3 may be the same material as the surfaces 4 (e.g., a substantially rigid material), but may have folded/foldable sections that allow for easier folding and closing of the cover 5.

Figure 2:
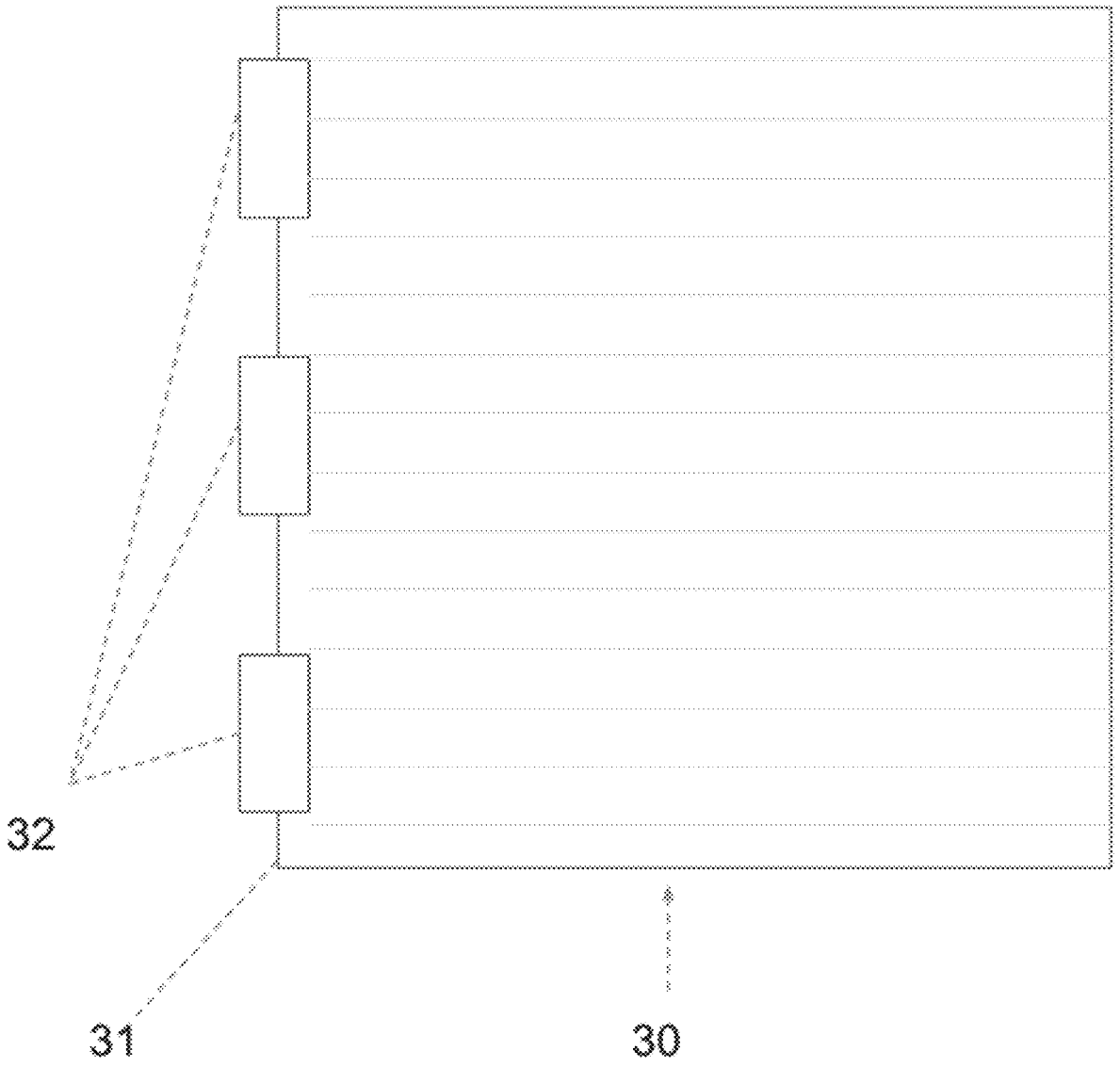
FIG. 2 schematically shows a front view of a modular notebook page pack in accordance with illustrative embodiments of the invention.

FIG. 2 schematically shows a front view of a modular writing surface 30 in accordance with illustrative embodiments of the invention. For discussion purposes, the modular writing surface 30 is referred to herein as a notebook page pack 30 ("page pack"). However, it should be understood that discussion of the page pack 30 may apply to various types of writing surfaces 30 (e.g., a pack of index cards). The page pack 30 is a stack of notebook pages 31 that may be bound together using a notebook binding element 32 (referred to as the "binding element"). The binding element 32 may be a ring (e.g., an elongated ring, such as a cylinder or tube) that binds the pages 31 together in a manner similar to a traditional binding (e.g., wire-o) or binder ring, but provides a substantially larger surface area that in various embodiments can enhance retention and/or turning of the writing surface and/or can enhance magnetic coupling of the binding element(s) 32 with writing surface(s) 31 to a magnetic spine 2.

In some embodiments, a plurality of ordinary metallic binder rings or spiral-bound rings may be used to bind the page pack 30 to the surface 4. However, the elongated binding elements 32 advantageously provide greater surface area, more holding power, and greater stability for the pages. Each page pack 30 has at least one binding element 32 to hold the pages together. Although FIG. 2 shows three binding elements 32, it should be understood that more or fewer binding elements 32 may be used. This may depend on the size of pages 31. Additionally, the size of the binding elements 32 may vary. For example, one large binding element 32 may be used instead of the three smaller binding elements 32 shown.

Furthermore, the binding element 32 may have different orientations and/or positions than that shown in FIG. 2. For example, the one or more binding elements 32 may be positioned along the top of the page pack 30, in addition to, or alternatively, to their positioning along the side of the page pack. Corresponding additions or alterations may also be made to the spine 2 and/or magnetic pads 1.

The page pack 30 may be formed of synthetic pages, such as those described in U.S. patent application Ser. No. 15/811,360 (now issued as U.S. Pat. No. 10,232,663), which is incorporated herein by reference in its entirety. Furthermore, illustrative embodiments may provide a reusable modular notebook, for example, by instructing the user to write on the synthetic paper with a thermochromic ink pen and to moisture-erase the thermochromic ink markings (e.g., using a damp cloth). Additionally, or alternatively, illustrative embodiments may provide an instruction to heat-erase (e.g., microwave) the thermochromic ink markings. However, it should be understood that illustrative embodiments may include page packs 30 formed of other material (e.g., traditional paper) and used with other types of writing utensils (e.g., a traditional pencil).

Figure 3A:
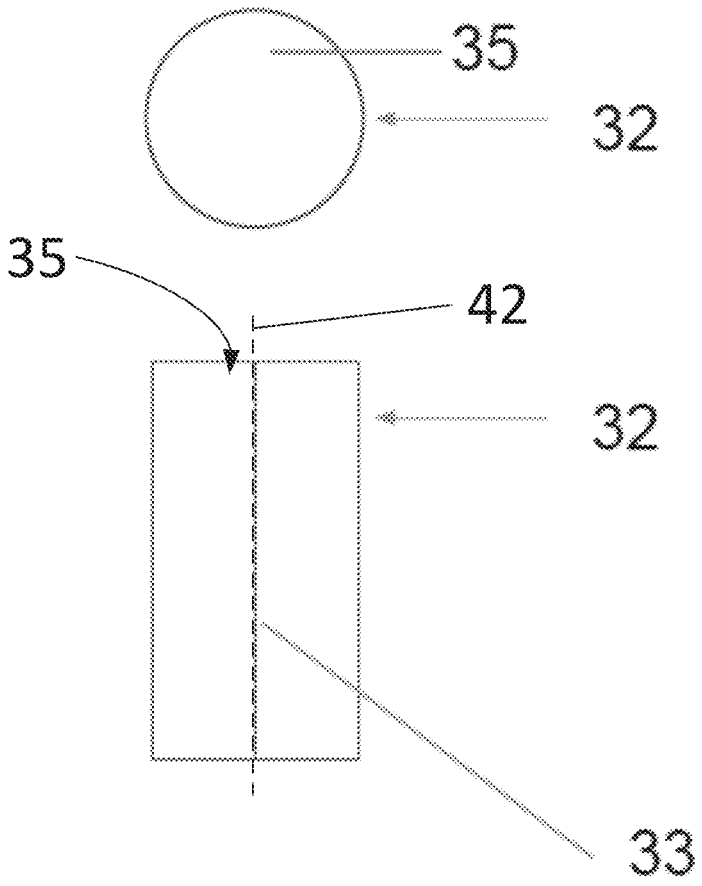
FIG. 3A schematically shows a top view and a side view of a binding element of the modular notebook in accordance with illustrative embodiments of the invention.

FIG. 3A schematically shows a top view and a side view of the binding element 32 of the modular notebook in accordance with illustrative embodiments of the invention. In illustrative embodiments the binding element 32 is formed from a ferromagnetic metal or other material that is attracted to magnets. The binding element 32 may initially be in the shape of a flat rectangle or other open shape that may be squeezed to form a cylindrical shape. This may result in a seam 33 on the binding element 32. In illustrative embodiments, the seam 33 does not significantly disrupt the inner or outer cylinder surface of the binding element 32. The inventors discovered that in some embodiments a large seam 33 affects the ability to turn pages 31 around the binding element 32. As can be seen from the top view, in some embodiments, the binding element 32 forms an opening (e.g., barrel 35). The closed binding element 32 has a central axis and/or longitudinal axis 42 running therethrough.

The binding element 32 may be positioned into a receiving slot (e.g., an elongated slot) in the page pack 30 and warped into a closed cylinder to bind the pages 31. Because the binding element 32 forms a substantially completely closed cylinder/tube with no beginning or end, the pages 31 can be endlessly turned around and around the binding element 32. This is advantageous when a user of the modular notebook would like to make the first page become the last page, leaving the second page as the first page. This may be advantageous in such applications as a reusable calendar, which is by nature an endless loop.

Figure 3B:
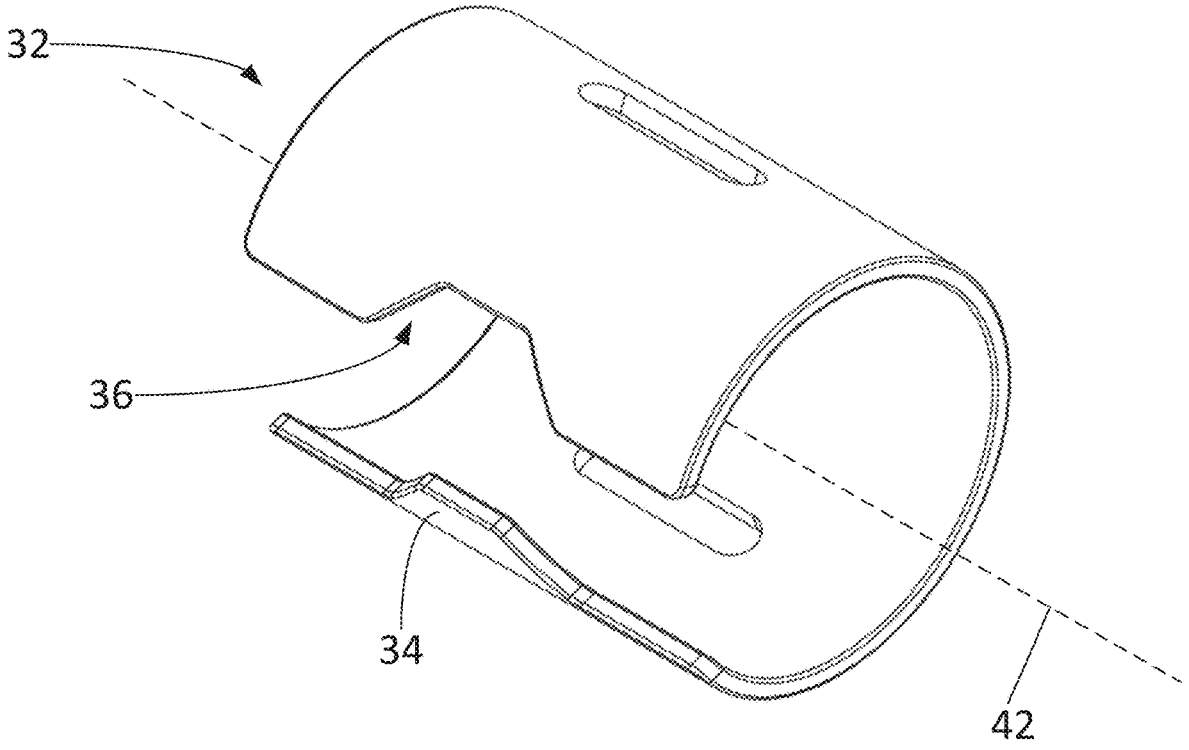
FIG. 3B schematically shows a perspective view of an alternative embodiment of the binding element of FIG. 3A.

FIG. 3B schematically shows an alternative embodiment of the binding element 32 in accordance with illustrative embodiments of the invention. The binding element 32 has a notch 34, without a counterpart notch recess 36, to assist with preventing pages 31 from escaping the seam 33 of the binding element 32. In FIG. 3B the binding element 32 is not completely closed for discussion purposes. However, it should be understood that in use the binding element 32 is closed to form the notched seam 33.

Figure 3C:
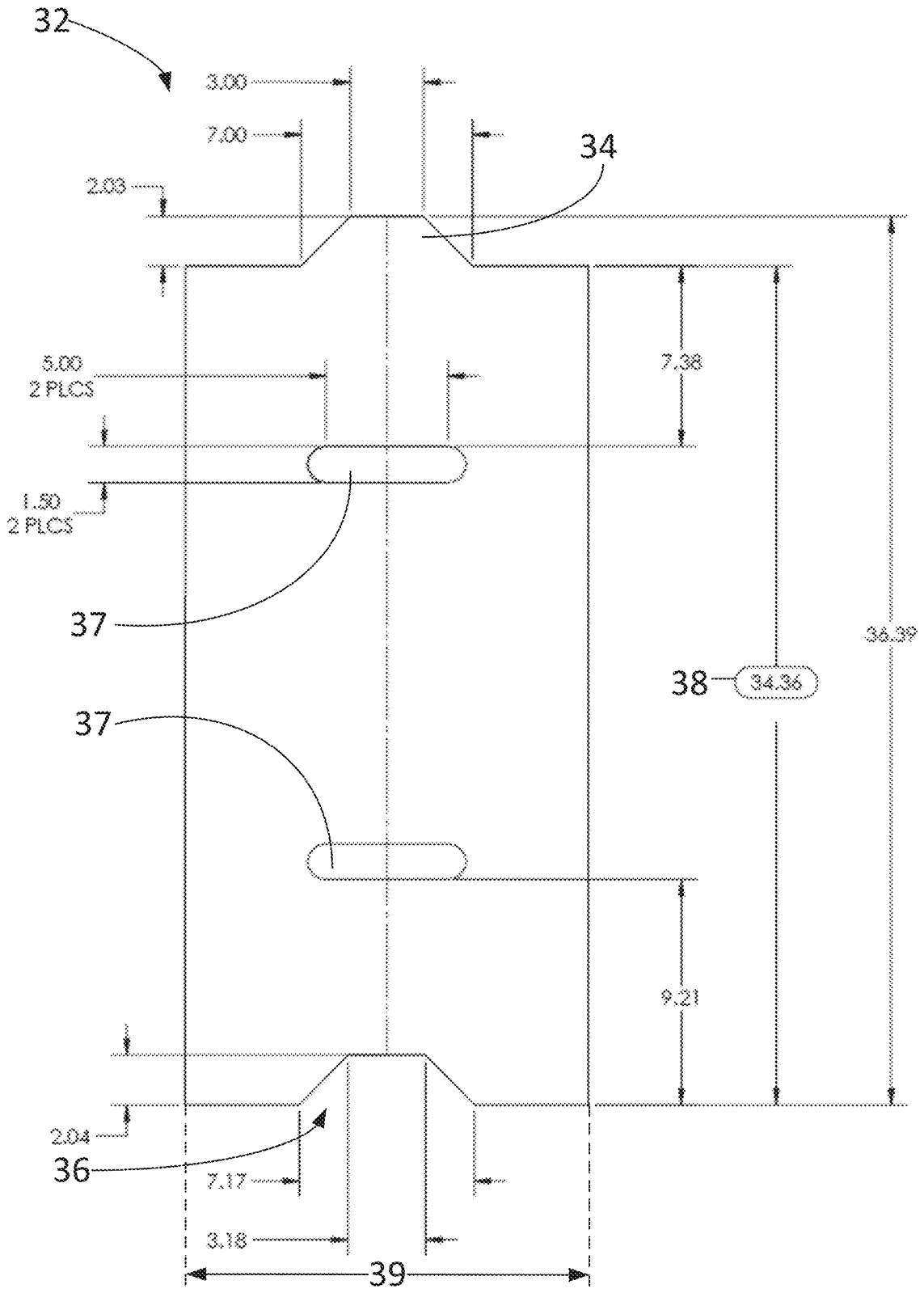
FIG. 3C schematically shows dimensions of an example of the binding element of FIG. 3B prior to bending.

FIG. 3C schematically shows dimensions of an example of the binding element shown in FIG. 3B. It should be understood that the dimensions are merely exemplary, and not intended to limit various embodiments of the invention. In illustrative embodiments, the binding element 32 is formed from a sheet of metal (e.g., a cold rolled steel sheet). Preferably, the sheet is 1 mm thick or less for ease of bending and also to allow for easier turning of pages 31. For example, the binding element 32 may be stamped out from a 0.6 mm thick sheet. The binding element 32 may have a circumference 38 of approximately 34 mm (not including the notch 34) after the sheet is bent into a circle. Thus, a sheet of about 34 mm may form a closed diameter 38 of about 11 mm. Preferably, the closed diameter 38 is greater than 8 mm to reduce the likelihood of the ring catching/snagging on the page.

The binding element 32 may also include one or more bend-assist openings 37 configured to receive portions of a machine that bend and close the binding element 32. Depending on the number of ring binding elements 32 used, the ring binding element may have a length of between about 10 mm and about 80 mm (e.g., 16.5 mm). It should be understood that the various dimensions of the binding element 32 shown in FIG. 3C are merely exemplary, and not intended to limit various embodiments of the invention.

Figure 4:
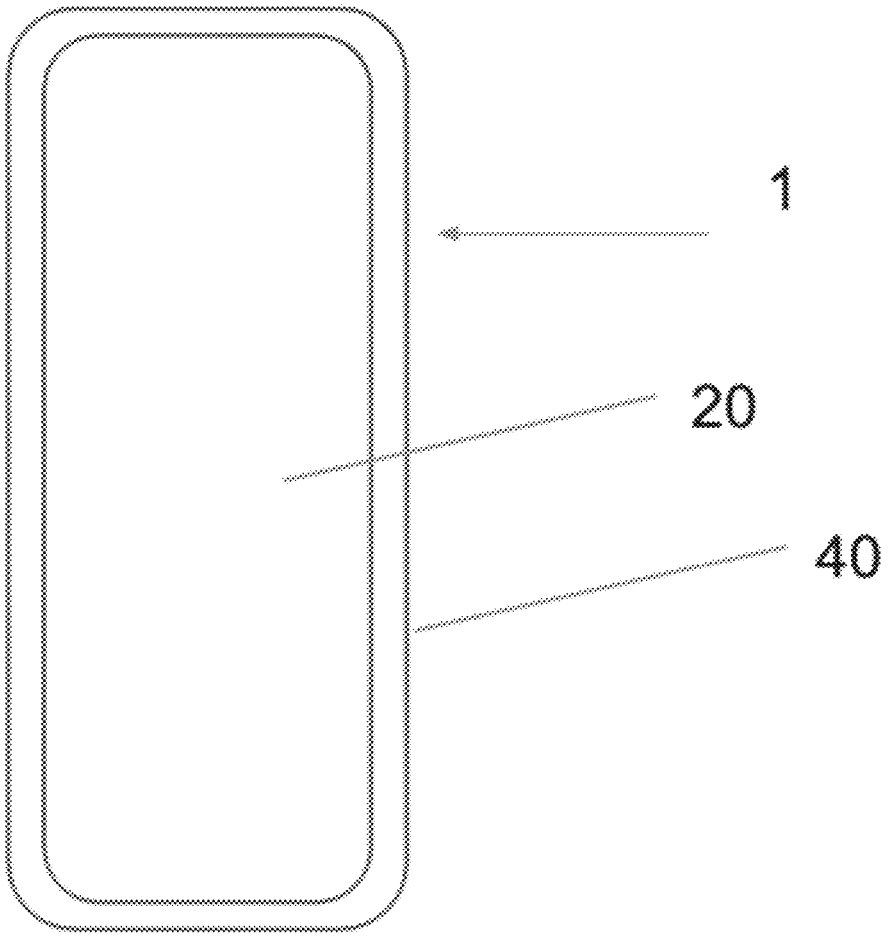
FIG. 4 schematically shows a magnetic pad in accordance with illustrative embodiments of the invention.

FIG. 3C schematically shows the binding element in a substantially planar format, prior to bending. FIG. 3B schematically shows the binding element transitioning to a substantially cylindrical format. It should be understood that in illustrative embodiments the binding element 32 is bent to form a substantially closed cylinder, as shown in FIG. 3A FIG. 4 schematically shows a magnetic pad 1 in accordance with illustrative embodiments of the invention. The magnetic pad 1 is configured to receive a binding element 32, and magnetically couple therewith. To that end, the magnetic pad 1 includes at least one magnet. Additionally, the magnetic pad 1 is configured to reduce the likelihood of and/or inhibit dislodgement of the binding element 32 by having a contoured surface, a wall (e.g., continuous or non-continuous), and/or a buttress. Some embodiments may include a pad 1 without magnets (e.g., with hooks 1185 instead of magnets).

One or more magnetic pads 1 may be mounted in the spine 2 to form a magnetic spine 2. In some embodiments, the spine 2 may be formed integrally with the magnetic pad(s) 1. In some other embodiments, the magnetic pad(s) 1 may be coupled to the spine 2 after manufacture. In some embodiments, the magnetic pads 1 may be integrated with and/or coupled with the cover 5 (e.g., one or more of surfaces 4). Accordingly, some embodiments do not require a spine 2 (e.g., a legal pad embodiment and/or a clipboard embodiment).

Among other things, the magnetic pad 1 may include a flat magnet covered with a rubber and/or plastic layer (e.g., PVC) for protection. In some other embodiments, the magnetic pad 1 may also have a contoured receiving portion 20 with some depth for receiving the binding element 32 (e.g., a concave surface that matches a radius of curvature of the binding element 32), and an outer wall 40 configured to mitigate accidental dislodgement of the binding element 32 from the pad 1. For example, the wall 40 may be in the shape of a long bowl or dinner plate. The inventors discovered that the contoured receiving portion 20 offers additional connective strength with the binding element 32. The receiving portion 20 may also be referred to as the receiving recess 20.

Figure 5:
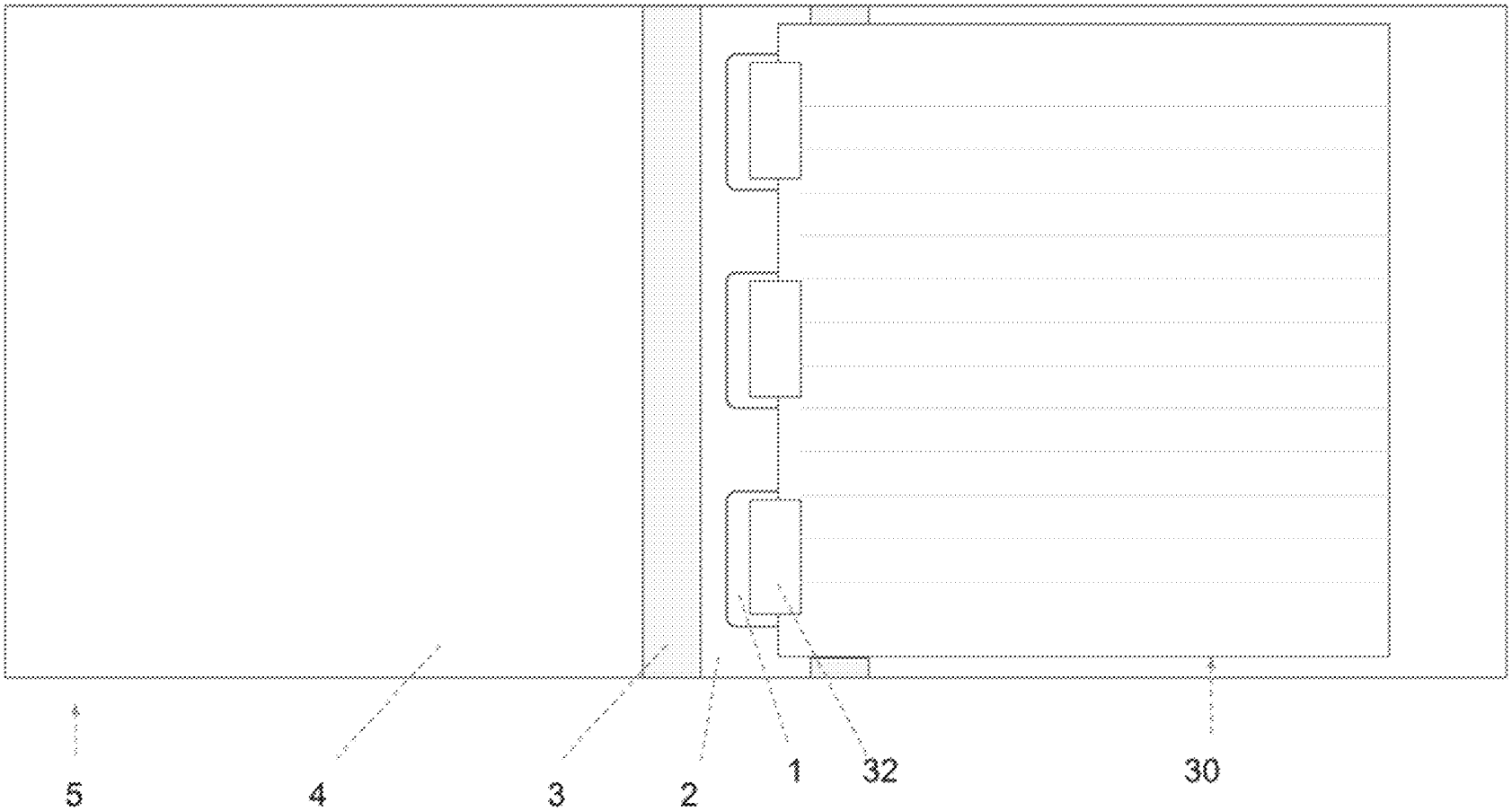
FIG. 5 schematically shows a system including the modular notebook cover and the modular notebook page pack in accordance with illustrative embodiments of the invention.

FIG. 5 schematically shows a system including the modular notebook cover 5 and the modular notebook page pack 30 in accordance with illustrative embodiments of the invention. In FIG. 5, the page pack 30 is coupled to the cover 5 via magnetic pads 1 and binding elements 32. In this configuration, the page pack 30 may be said to semi-permanently couple with the cover 5. For example, the magnetic attraction between the pad 1 and the binding element 32 is strong enough so that the page pack 30 may be removed from the notebook by force from a user, but that the weight of the page pack 30 itself is not sufficient to uncouple the pad(s) 1 from the binding element(s) 32 (e.g., from a dead hang if the notebook is held open facing downward). Accordingly, the magnetic force between the magnets 1 and the binding elements 32 is sufficient to retain the page pack 30 during normal use.

As mentioned earlier, the binding elements 32 may be magnetically attractive. Accordingly, the binding elements "stick" to the magnetic pads 1 mounted on the magnetic spine 2. It can be seen with the binding elements 32 now coupled to the magnetic spine 2 that the modular notebook appears and functions like a "normal" notebook with pages 31 bound (e.g., magnetically) inside the cover 5. It should be noted, however, that some embodiments may include binding elements 32 that are not magnetically attractive.

Figure 6A:
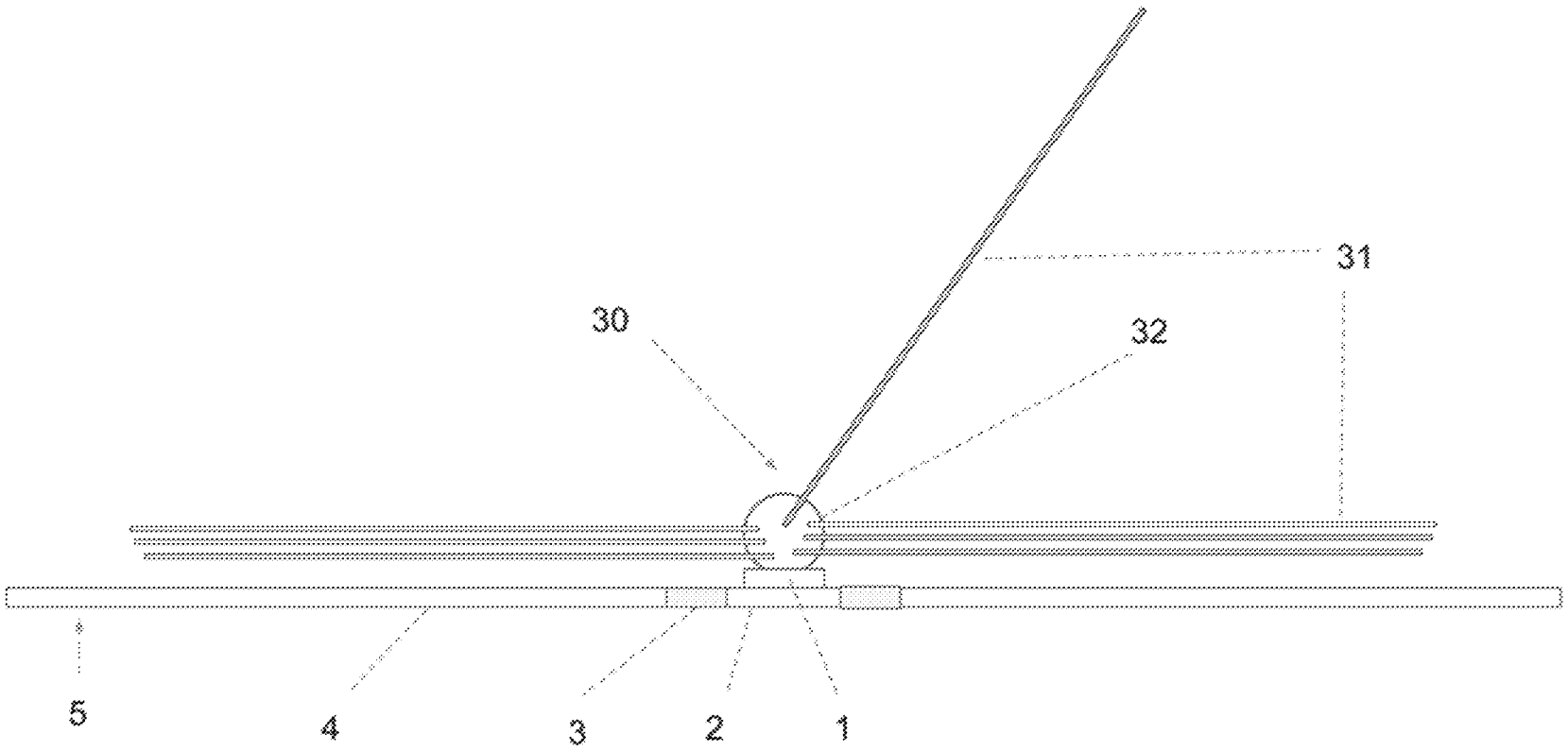
FIG. 6A schematically shows a top view of FIG. 5.

FIG. 6A schematically shows a top view of FIG. 5. The modular notebook has the page pack 30 coupled with the cover 5. In illustrative embodiments, the spine 2 with flexible material 3 provides the advantage that the pages 31 may be turned like a normal notebook and lay flat against the rigid surfaces 4. For example, having flexible material 3 on both sides of the spine 2 allows the notebook to lay entirely flat, which may provide users with increased comfort while writing in the notebook.

Figure 6B:
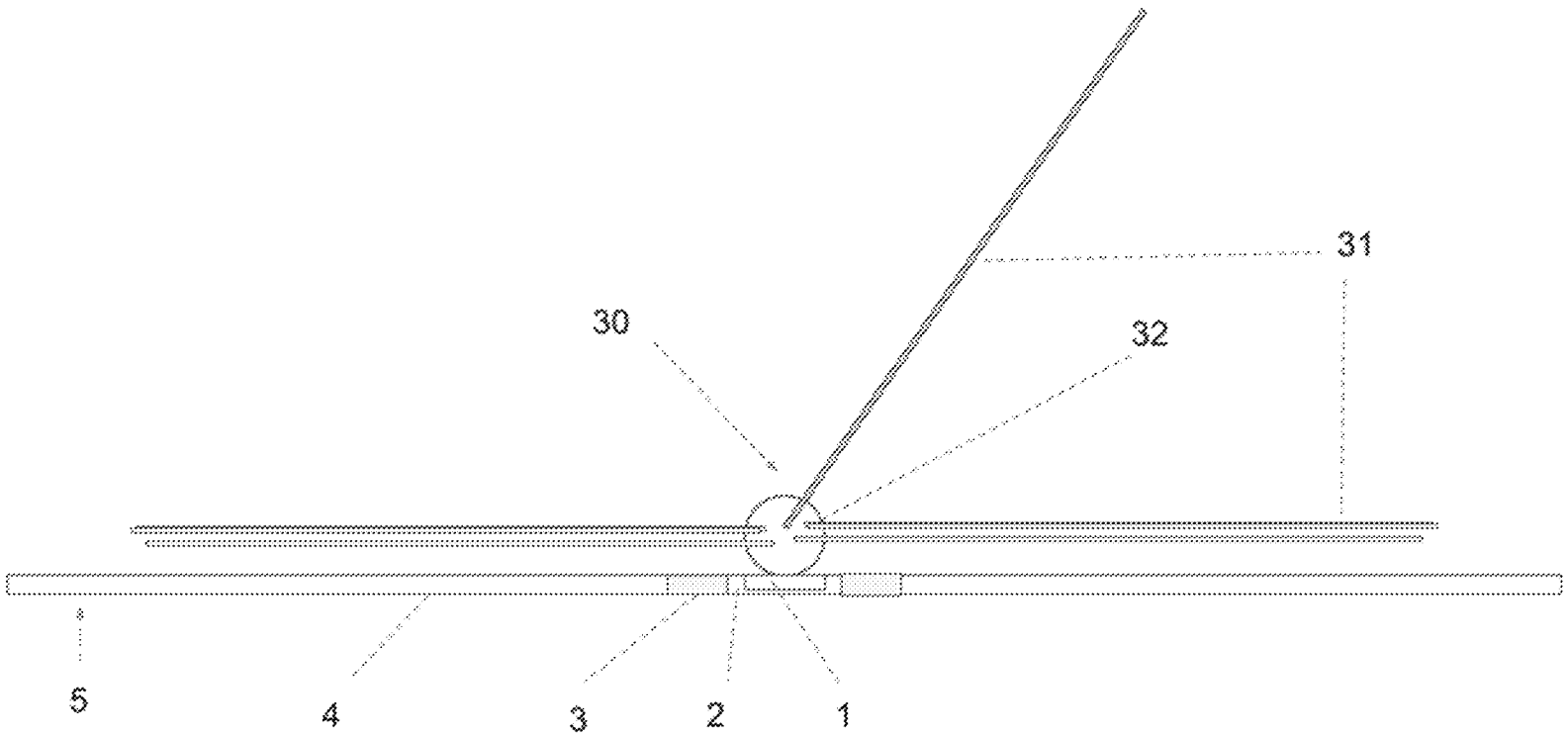
FIG. 6B schematically shows a top view of an alternative embodiment of FIG. 5.

Furthermore, although the pads 1 are shown as protruding from the spine 2, in some embodiments the pads 1 or portions thereof are recessed into the spine 2. For example, the receiving portion 20 may be recessed into the spine 2, while the outer wall 40 may protrude from the spine 2. Thus, the pads 1, or portions, thereof may be substantially flush with and/or recessed into the spine 2 (e.g., see FIG. 6B). Accordingly, the binding element 32 may be positioned into the pad 1, and one or more of the pages 31 may also lay flat.

Figure 7:
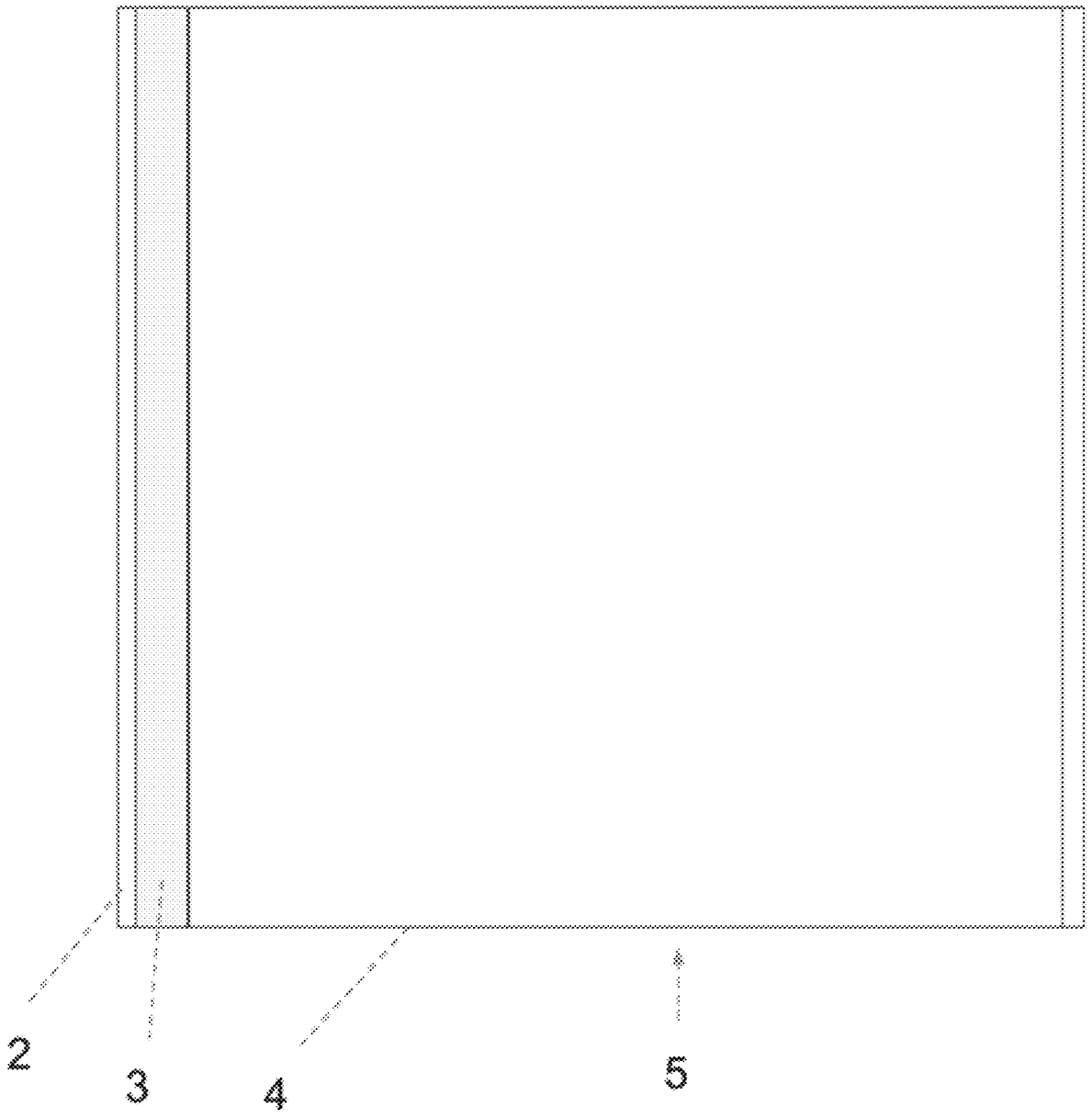
FIG. 7 schematically shows a front view of the modular notebook cover in a closed configuration in accordance with illustrative embodiments of the invention.

FIG. 7 schematically shows a front view of the modular notebook cover 5 in a closed configuration in accordance with illustrative embodiments of the invention. In this view, only one of the surfaces 4 is completely visible. Because of the flexible material 3 that connects the rigid magnetic spine 2 to the rigid surfaces 4, the notebook closes in such a way that the binding 2 lays flat, rather than being upright. Accordingly, the notebook maintains a slim form factor in the closed configuration.

Figure 8:
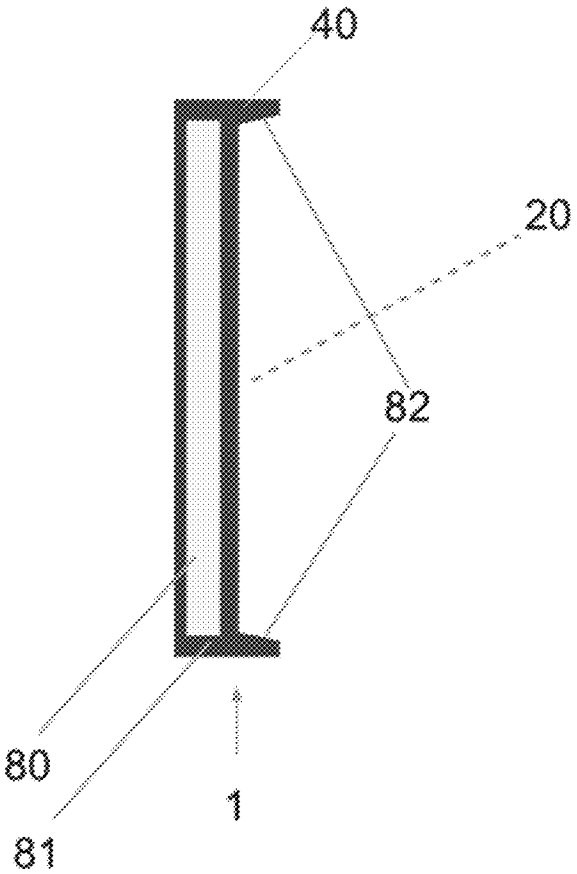
FIG. 8 schematically shows a cross-sectional view of the magnetic pad of FIG. 4.

FIG. 8 schematically shows a cross-sectional view of the magnetic pad 1 of FIG. 4. The magnetic pad 1 includes a magnet 80 that may be partially or fully enclosed in a protective material 81 (e.g., plastic or rubber). In some embodiments, the magnetic pad 1 has contoured inner walls 82 that help seat the binding element 32. As discussed previously, the receiving portion 20 may have a concave surface (e.g., that matches the shape of the binding element 32). Although the inner walls 82 are shown as contoured, one or more of the walls 82 may form a ninety-degree angle with the surface of the receiving portion (i.e., may not be contoured).

Figure 9:
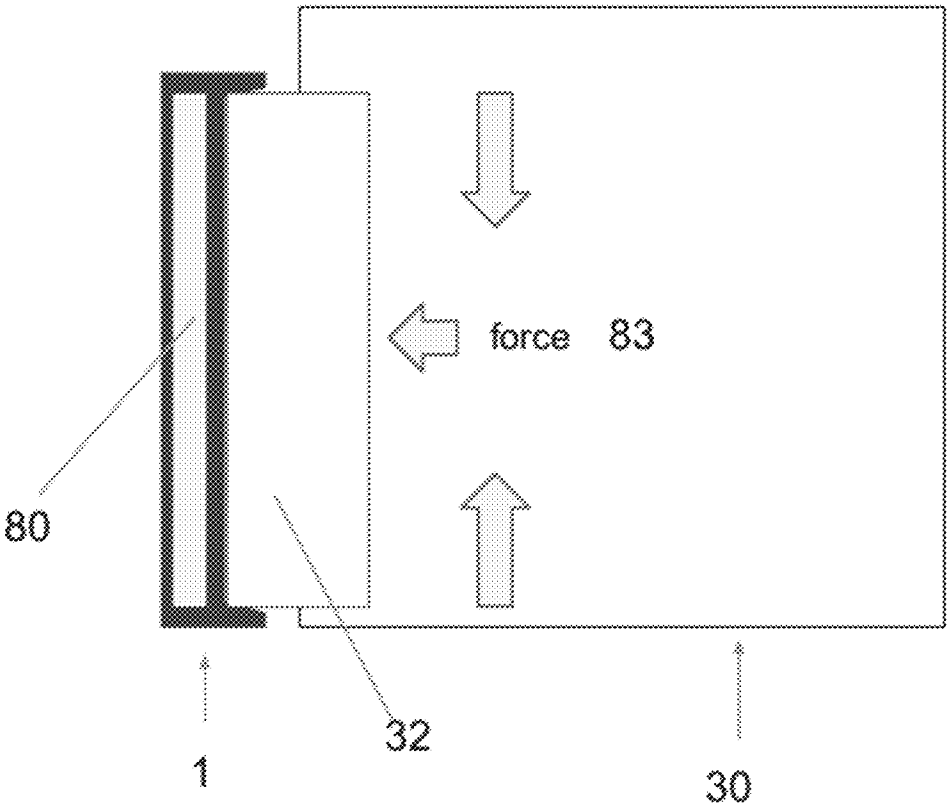
FIG. 9 schematically shows a cross-sectional view of the magnetic pad coupled with the binding element in accordance with illustrative embodiments of the invention.

FIG. 9 schematically shows a cross-sectional view of the magnetic pad 1 coupled with the binding element 32 in accordance with illustrative embodiments of the invention. The attraction between the magnet 80 and the binding element 32 pulls the binding element 32 inward towards the magnet 80. The contoured walls 82 may prevent motion along the longitudinal axis of the pad 1 and/or spine 2 (e.g., inhibits substantial up or down movement of the binding element 32 relative to the pad 1). Additionally, or alternatively, the contoured walls 82 may prevent motion in a direction transverse to the longitudinal axis of the pad 1 and/or the spine 2 (e.g., inhibits left or right movement of the binding element 32 relative to the pad 1). The contoured walls 82 may assist with proper positioning of the binding element 32 in the pad 1.

The forces 83 schematically show the process of positioning the binding element 32 in the pad 1. For example, the binding element 32 is moved up and/or down until it is substantially aligned with the corresponding pad 1. The binding element 32 is then pushed into the pad 1 (e.g., a receiving portion 20 of the pad 1).

By coupling the binding element 32 in place with the pad 1, the page packs 30 may also be "locked" into place inside the modular notebook. Thus, only a force that overpowers the force of the magnet 80 removes the page pack 30 from the magnetic pad 1. The pad 1 and binding element 32 are configured so that the page packs 30 do not have a tendency to simply fall out due to the orientation, shaking, vibration, or other normal use conditions of the modular notebook. In other words, in some embodiments, the strength of the attraction between the pad 1 and the binding element 32 is configured to overcome the weight of the page pack 30. For example, the pull force required to dislodge the binding elements 32 from the magnet(s) 80 may be a total of between 3 lbs. and 5 lbs. The pull force is measured as the amount of force required to dislodge all of the binding elements 32 from the magnets 80 (and does not account for the weight of the page pack 30). In some embodiments, the pull force may be up to 10 lbs.

Figure 10:
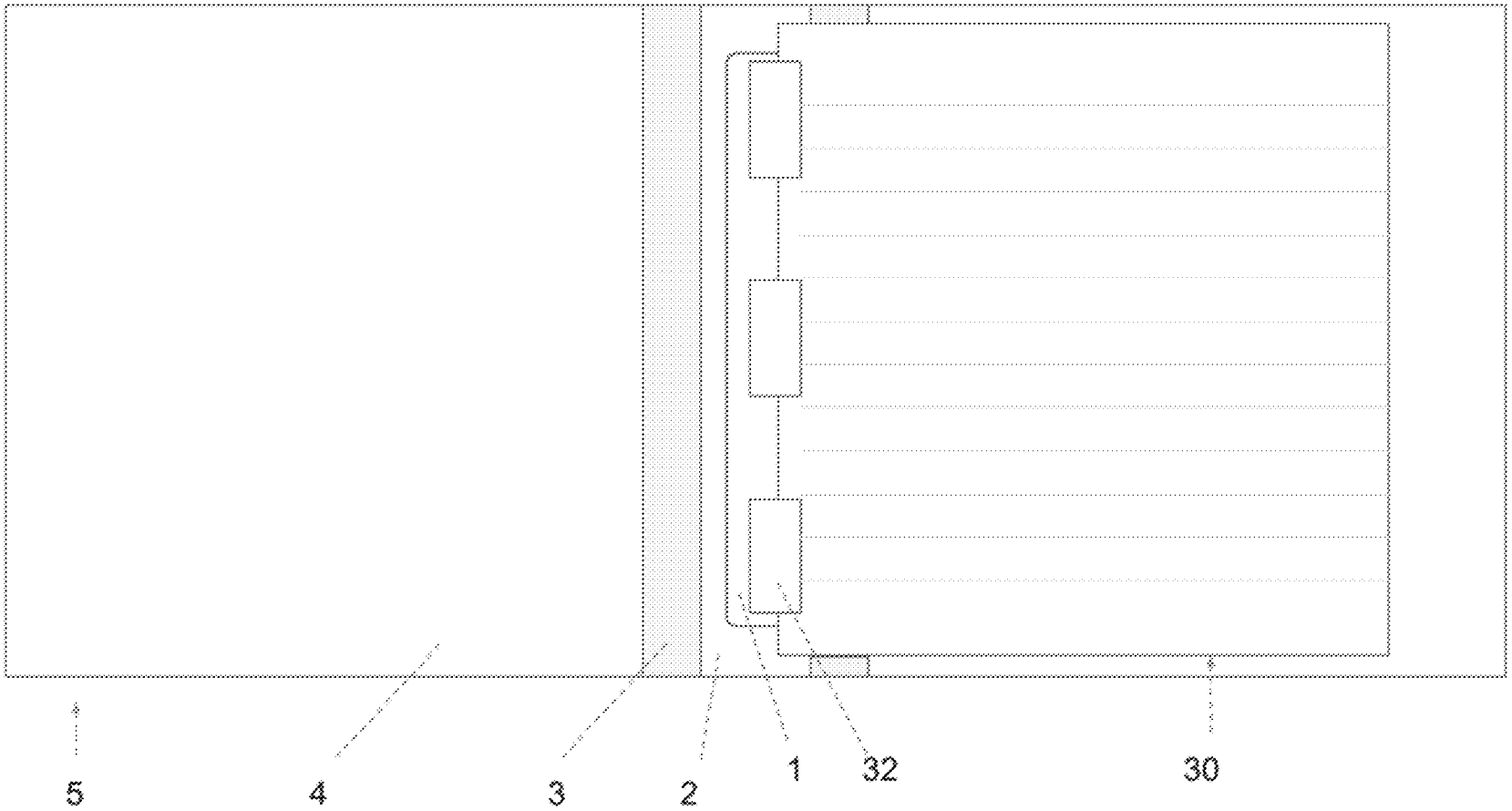
FIG. 10 schematically shows another embodiment of the modular notebook cover with the modular notebook page pack in accordance with illustrative embodiments of the invention.

FIG. 10 schematically shows another embodiment of the modular notebook cover 5 with the modular notebook page pack 30 in accordance with illustrative embodiments of the invention. There are many variations of illustrative embodiments of the magnetic pad(s) 1 and binding element(s) 32. A person of skill in the art should understand that the modular notebook may be constructed with multiple binding elements 32 that couple with a single larger magnetic pad 1, as shown in FIG. 10. Alternatively, or additionally, multiple magnetic pads 1 could be used to connect to a single binding element 32 (e.g., if the magnetic pads 1 either had no outer wall 40 and/or contoured wall 82, or the wall surrounded multiple pads 1). As an additional example, one larger (e.g., elongated) binding element 32 used to bind the page pack 30 may fit into a single pad 1.

Figure 11:
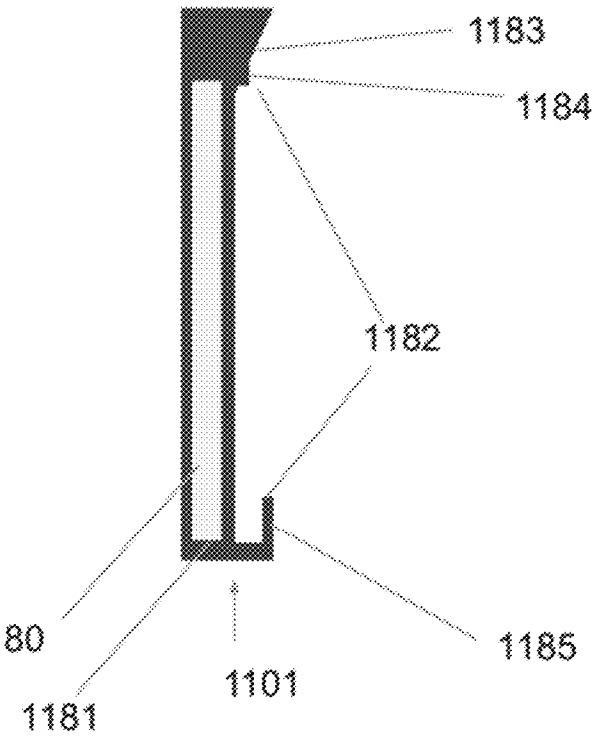
FIG. 11 schematically shows a cross-sectional view of an alternative embodiment of the magnetic pad.

FIG. 11 schematically shows a cross-sectional view of an alternative embodiment of the magnetic pad 1101. Similar to the magnetic pad 1 described previously, the magnet 80 is covered by protective material 1181. However, part of the pad 1101 (e.g., the protective material 1181) forms a hook 1185 at least on one end of the magnetic pad 1101. On the other end of the pad 1101 is a ramp 1183 and a bump 1184. Some embodiments may include a detent alternatively, or in addition to, the bump 1184.

Figure 12:
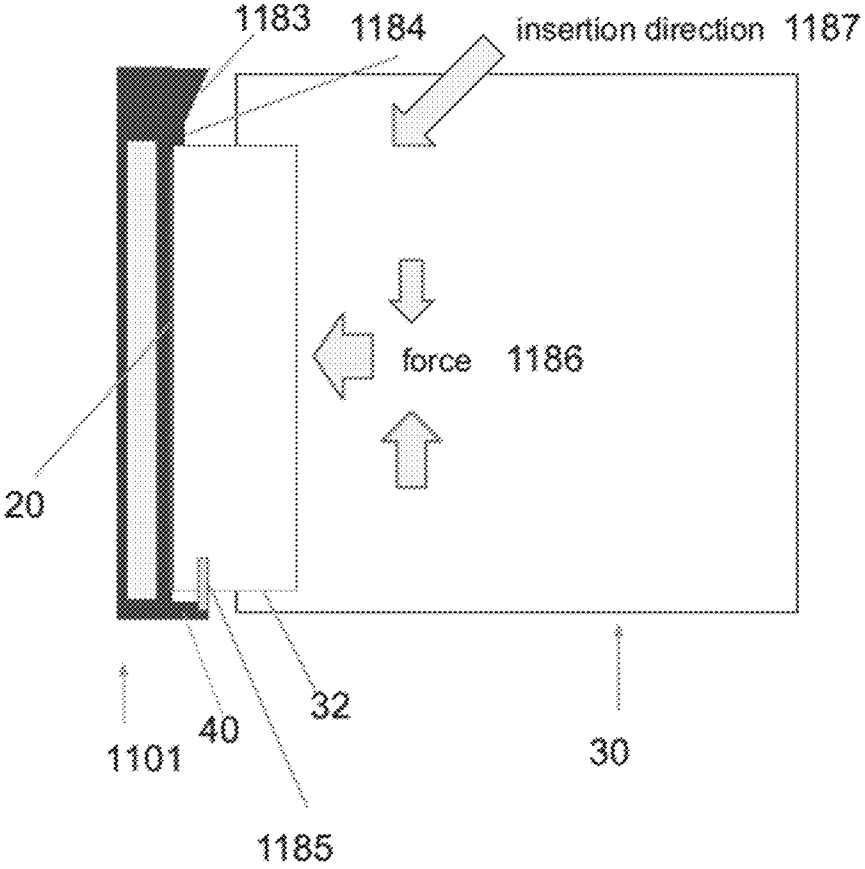
FIG. 12 schematically shows a cross-sectional view of the magnetic pad of FIG. 11 coupled with the binding element in accordance with illustrative embodiments of the invention.

FIG. 12 schematically shows a cross-sectional view of the magnetic pad 1181 of FIG. 11 coupled with the binding element 32 in accordance with illustrative embodiments of the invention. FIG. 12 shows the already inserted page pack 30 with the binding element 32 seated in the magnetic pad 1101. Advantages of the alternative magnetic pad 1101 are discussed with reference to FIG. 12. In illustrative embodiments, the page pack 30 is inserted from the top, as shown in the figure. The binding element 32 travels down the ramp 1183, falls over the bump 1184, travels along the receiving surface 20 of the magnetic pad 1101 and reaches the hook 1185 at the other end. The hook 1185 is thus positioned into the barrel 35 of the binding element 32.

Figure 13:
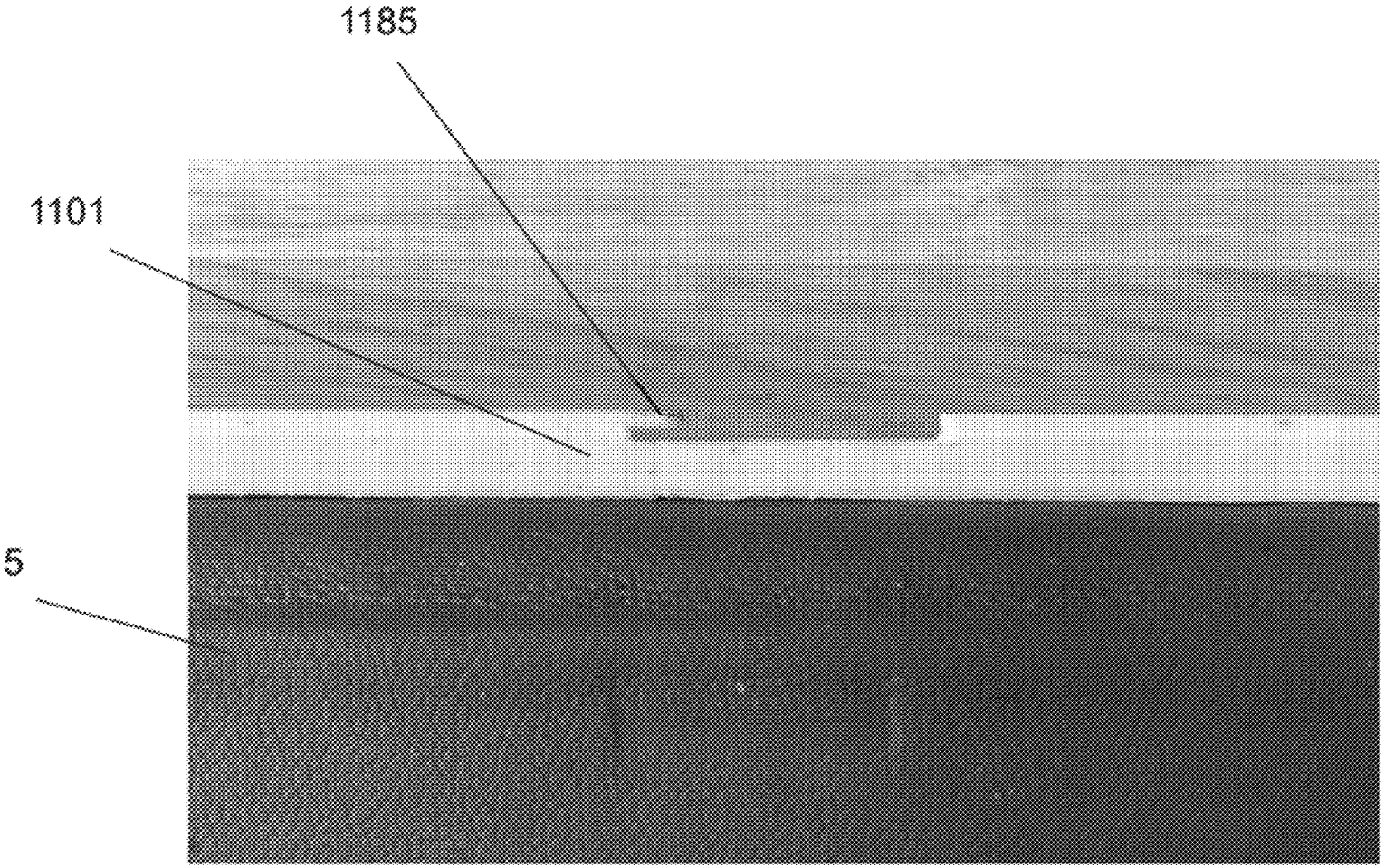
FIG. 13 schematically shows a side view of a hook in accordance with illustrative embodiments of the invention.
Figure 14:
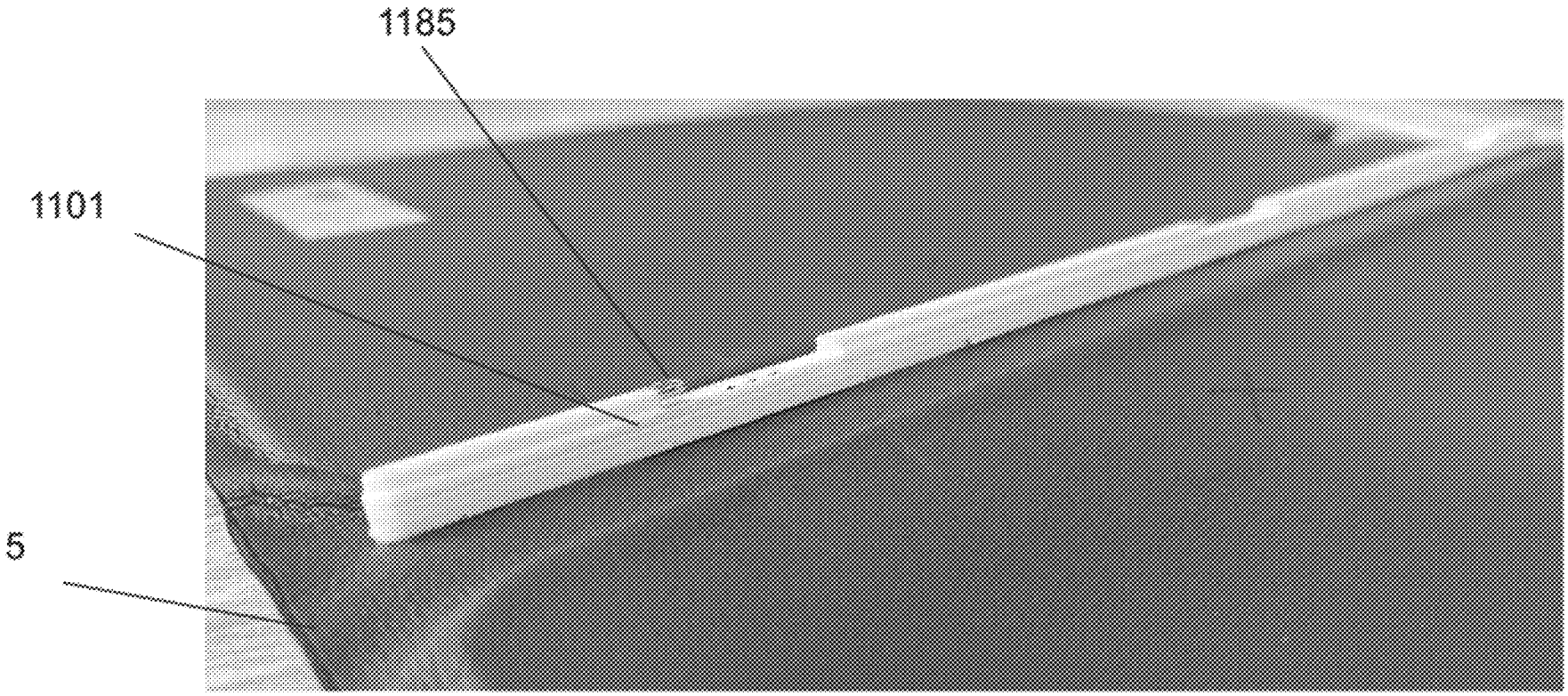
FIG. 14 schematically shows a perspective view of an alternative embodiment of the magnetic pad in accordance with illustrative embodiments of the invention.
Figure 15:
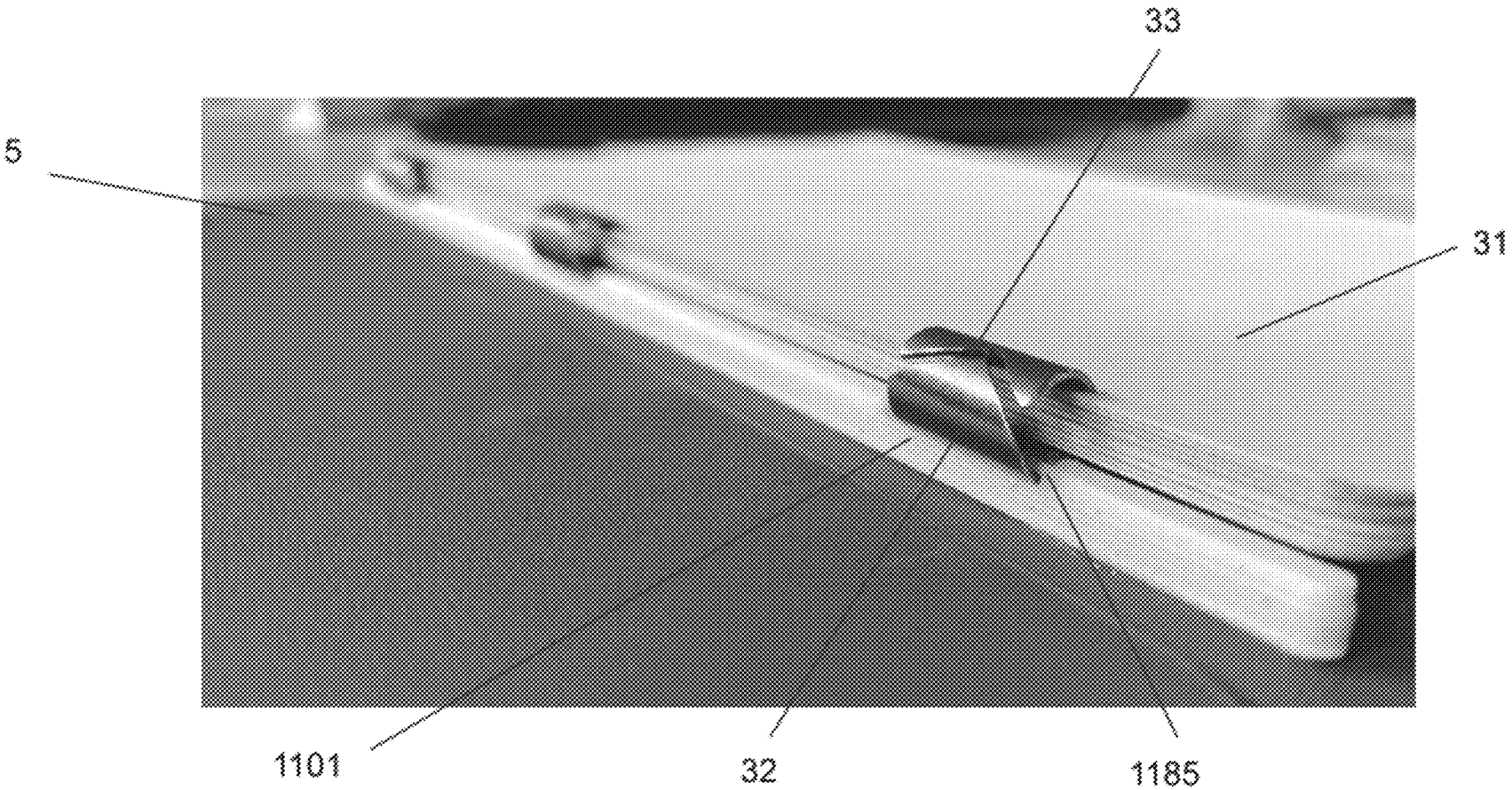
FIG. 15 schematically shows a perspective view of the magnetic pads with the hook coupled with binding elements in accordance with illustrative embodiments of the invention.
Figure 16:
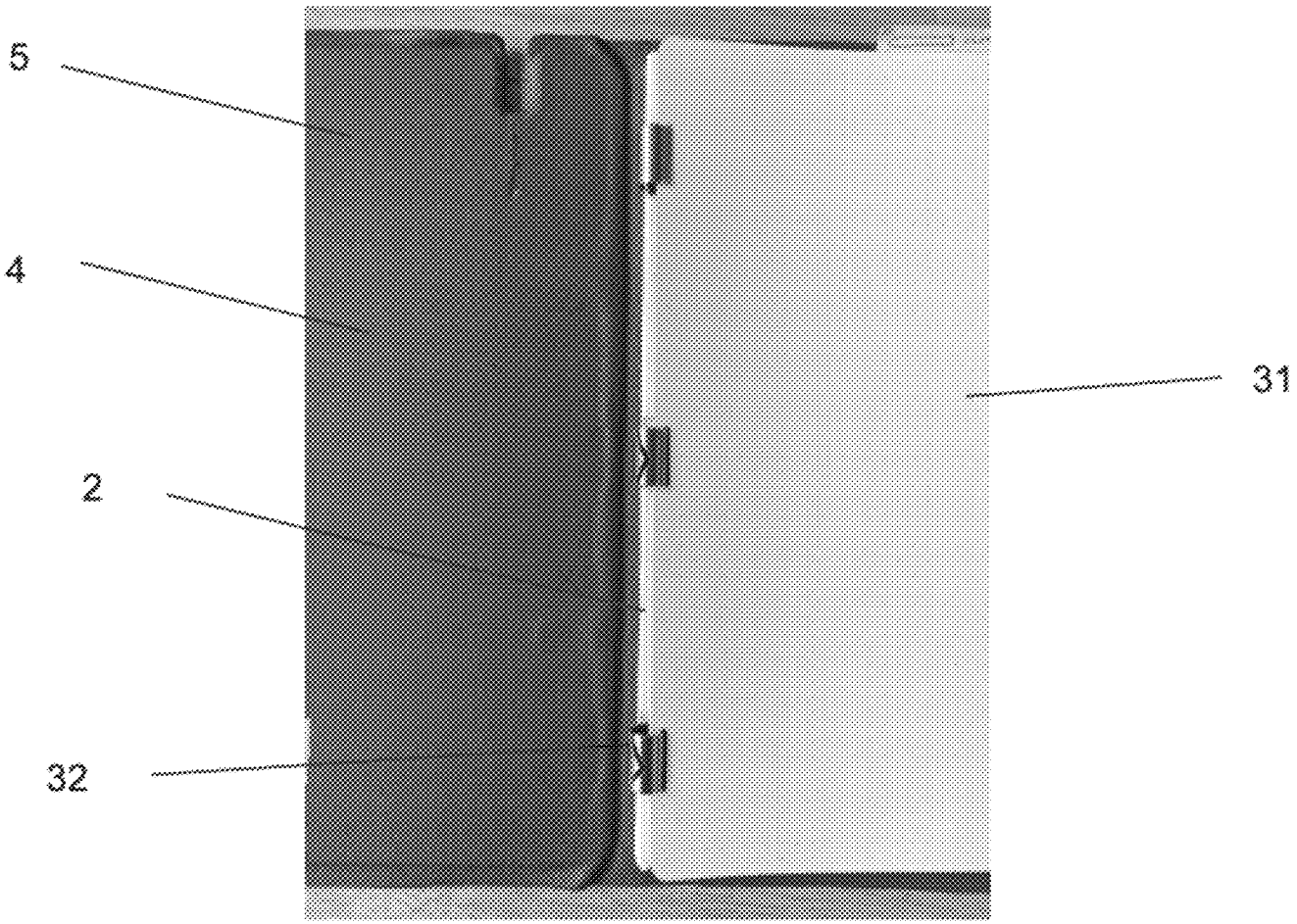
FIG. 16 schematically shows a front view of FIG. 15.

FIG. 13 schematically shows a side view of the hook 1185 in accordance with illustrative embodiments of the invention. FIG. 14 schematically shows a perspective view of an alternative embodiment of the magnetic pad 1101. FIG. 15 schematically shows a perspective view of the magnetic pads 1101 with the hook 1185 coupled with binding elements 32 in accordance with illustrative embodiments of the invention. FIG. 16 schematically shows a front view of FIG. 15. As can be seen, the seam 33 is configured to form a V-shape, such that the likelihood of accidental dislodgement of pages 31 is reduced. Furthermore, it should be understood that the description and features of magnetic pad 1 apply to the magnetic pad 1101, and vice-versa. Thus, illustrative embodiments of the magnetic pad 1101 may have an outer wall 40 that entirely surrounds a contoured receiving portion 20, and/or other features described with reference to magnetic pad 1.

Furthermore, although FIGS. 13-16 schematically show the magnetic pad as protruding from the spine 2 and/or cover 5, it should be understood that in some embodiments the pads 1 or portions thereof are recessed into the spine 2 and/or the rigid surface 4. For example, the magnetic pad 1101 may have the receiving portion 20 recessed into the spine 2, while the outer wall 40 may protrude from the spine 2. Thus, the pads 1101, or portions, thereof may be substantially flush with and/or recessed into the spine 2 (e.g., see FIG. 6B). Accordingly, the binding element 32 may be positioned into the pad 1, and one or more of the pages 31 may also lay flat.

After proper insertion, the page pack 30 requires a given amount of force to remove in all directions. In illustrative embodiments, the protective material 1101 (e.g., the wall 40) holds the bottom of the binding element 32 firmly. On the top, the bump 1184 prevents unintentional motion upward. Additionally, the magnetic force and the hook 1185 retain the binding element 32 in the receiving portion 20 and prevent/inhibit motion outwards (or to the right in FIG. 12).

The page pack 30 may be removed from the magnetic pad 1. For example, the magnetic force is overcome by pulling the binding element 32 out enough to get beyond the bump 1184. This allows the page pack 30 to uncouple from the pad 1101 by gliding the binding element 32 back up the ramp 1183 until the binding element 32 is beyond the hook 1185.

Illustrative embodiments include a number of variations for the ramp 1183 and the bump 1184. For example, in some embodiments, there are no ramps 1183 and/or bumps 1184. Accordingly, the page pack 30 may be retained by two opposing hooks 1185 and/or magnetic force sufficient to retain the binding element and page pack 30. In some embodiments, the page packs 30 may be retained merely by the hooks 1185 without any magnets 80. For example, the one or more hooks 1185 may be sufficiently long (e.g., extend into the barrel 35 of the binding element 32) to hold the ring and the page packs 30. The one or more hooks 1185 help to reduce the likelihood that the binding element 32 uncouples from the magnetic when pages 31 are turned by a user. In some embodiments, the hook 1185 is flexible, such that sufficient force exerted by the user may overcome the hook 1185. Accordingly, some embodiments may have two flexible hooks 1185 (e.g., instead of a hook 1185 and a bump 1184). Furthermore, some embodiments may not include a magnet 80. Instead, for example, the hook(s) 1185 and/or bump 1184-ramp 1183 arrangements may hold the page pack 30 to a surface of the notebook.

It should be understood that illustrative embodiments may include a number of variations of magnetic pads 1 and/or binding elements 32. Additionally, some embodiments may have pads 1 without magnets. As described previously, the pads 1 help retain the binding element 32. It should be understood that the pad 1 doesn't have to be a separate component from the cover 5 and/or the rigid surface 4. In illustrative embodiments, the pad 1 acts as a binding element 32 receiving portion.

Based on the present disclosure, a person of ordinary skill in the art will understand how to construct a modular notebook with multiple binding elements 32 that couple with a single larger magnetic pad 1101 (e.g., as shown in FIG. 10). As an additional example, one larger (e.g., elongated) binding element 32 used to bind the page pack 30 may fit into a single pad 1.

Furthermore, although various embodiments refer to configurations of magnetic pads 1, it should be understood that some embodiments may have no pads 1 at all. Instead, magnets 80 may be included in place of the pads. The inventors believe that the pads 1 advantageously enhance retention of the binding element 32, but tests have shown that magnets 80 alone (e.g., without pads 1 or hooks 1185) may be sufficient to provide retention of certain weight page packs 31 and binding elements 32.

Figure 17:
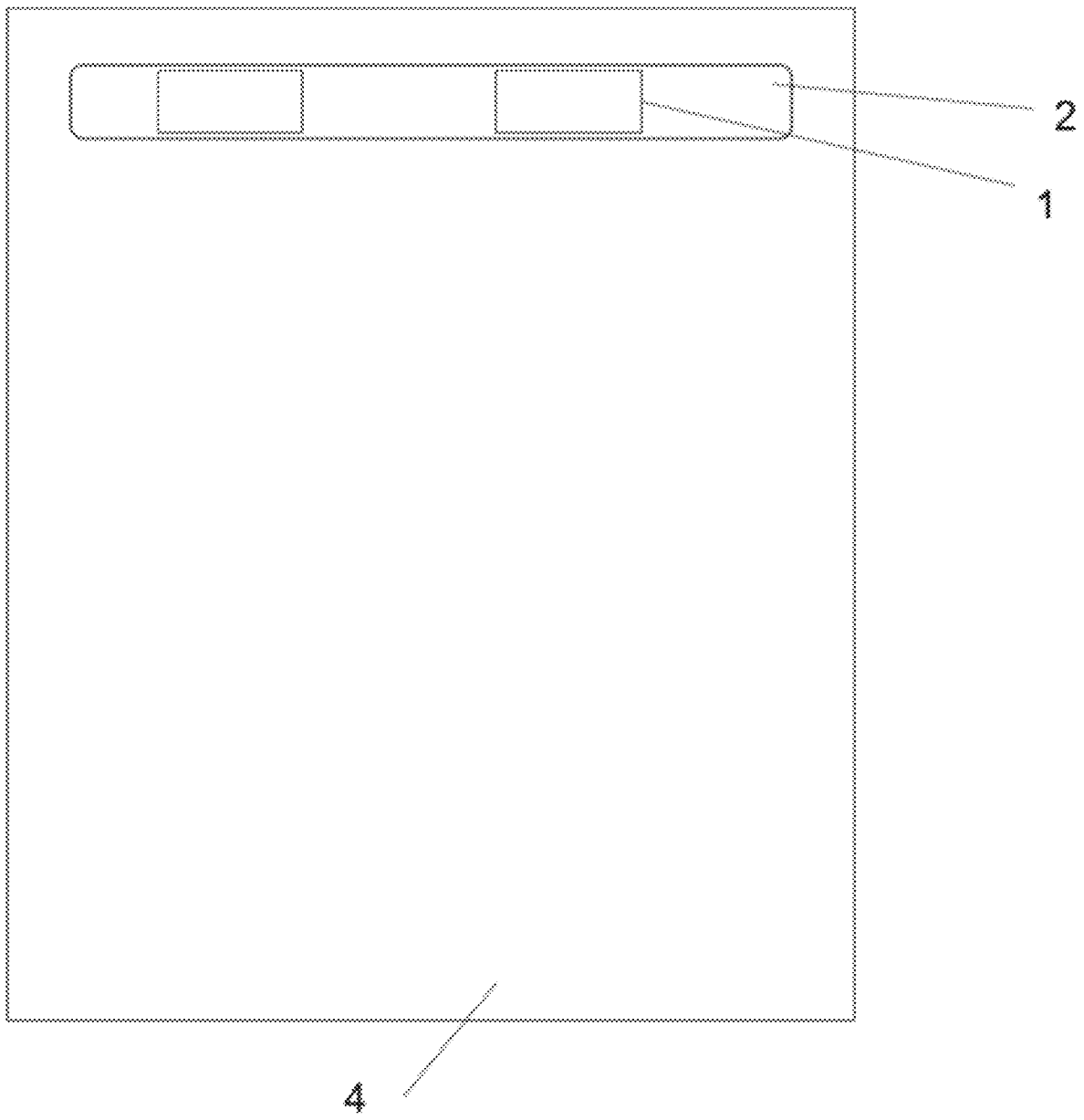
FIG. 17 schematically shows a front view of an alternative embodiment having the magnetic spine in a different orientation in accordance with illustrative embodiments of the invention.
Figure 18:
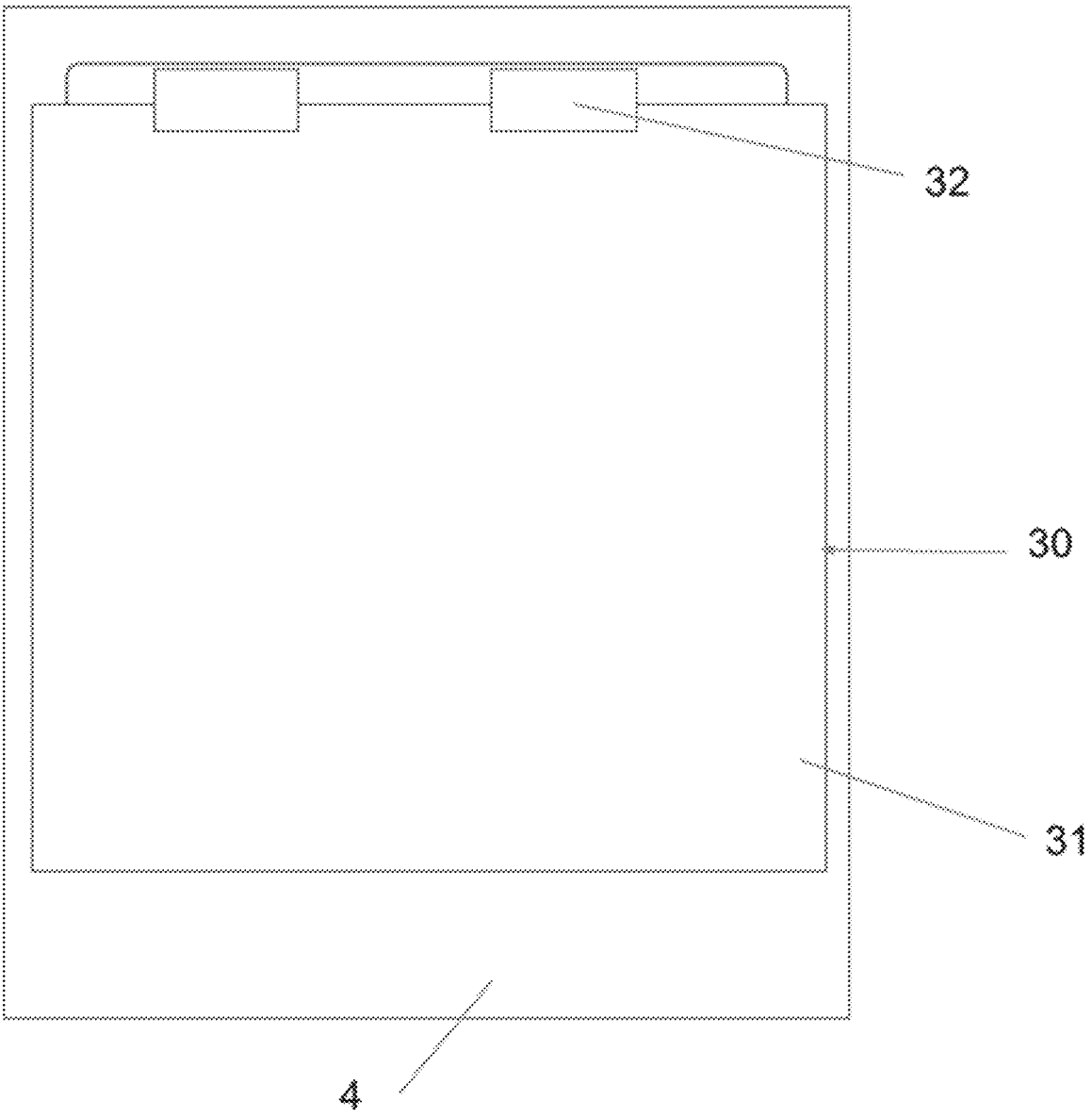
FIG. 18 schematically shows the magnetic spine of FIG. 17 with a page pack inserted.

FIGS. 17 and 18 show an alternative embodiment of the modular notebook configured as a legal pad and/or clipboard style writing pad. Specifically, FIG. 17 schematically shows a front view of an alternative embodiment having the magnetic spine 2 in a different orientation in accordance with illustrative embodiments of the invention. As shown, illustrative embodiments may include a rigid back 4, but no cover. In illustrative embodiments, the magnetic spine 2 and the binding elements 32 are positioned at the top of the surface 4 rather than the center or the side. Additionally, the spine 2 is oriented horizontally relative to the longitudinal axis of the surface 4 and/or page 31. It should be understood that illustrative embodiments may be modified to include a variety of cover and page styles and orientations.

FIG. 18 schematically shows the magnetic spine of FIG. 13 with a page pack 30 coupled thereto. Although illustrative embodiments refer to the magnetic spine 2, it should be understood that in various embodiments the spine 2 may not be magnetic. Instead, for example, the spine 2 may hold the page pack 30 using the hooks 1185 described previously.

Figure 19:
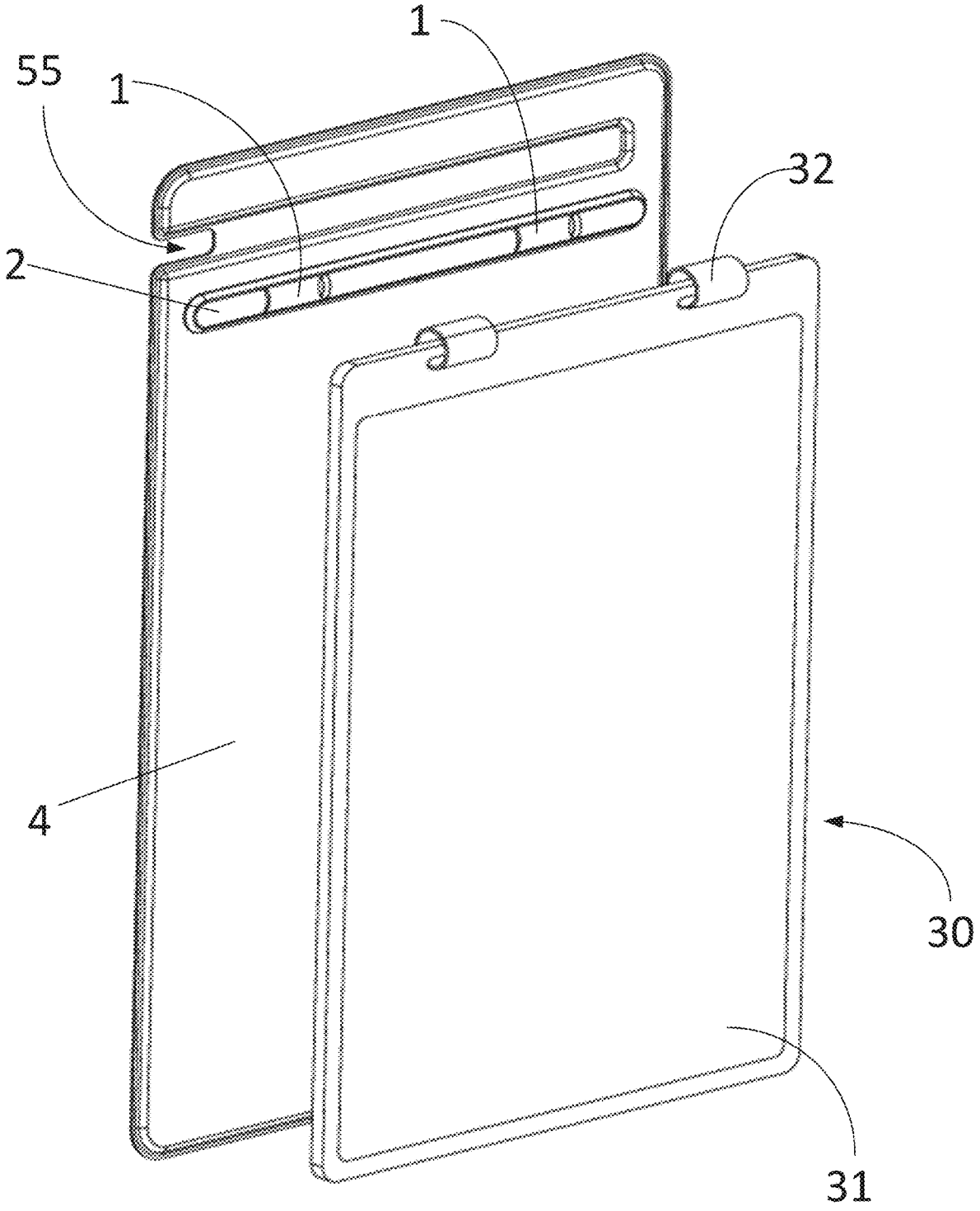
FIG. 19 schematically shows an alternative embodiment having the magnetic spine oriented horizontally in accordance with illustrative embodiments of the invention.

FIG. 19 schematically shows an alternative embodiment having the magnetic spine 2 oriented horizontally in accordance with illustrative embodiments of the invention. The spine 2 includes two magnetic pads 1 having a concave contoured shaped. Additionally, the rigid surface has a cutout and/or thinned area known as a pen dock 55. Preferably, the pen dock 55 is at least the width of a writing utensil, such as a Pilot FriXion ball-point gel pen. The pen dock 55 is sufficiently thin that the writing utensil may be attached thereto using the clip found on many conventional writing utensils, such as the Pilot FriXion ball-point gel pen. User experience testing indicates that the location of the pen dock 55 oriented above the writing surface 31 is preferred, although other positions are contemplated in illustrative embodiments.

Figure 20:
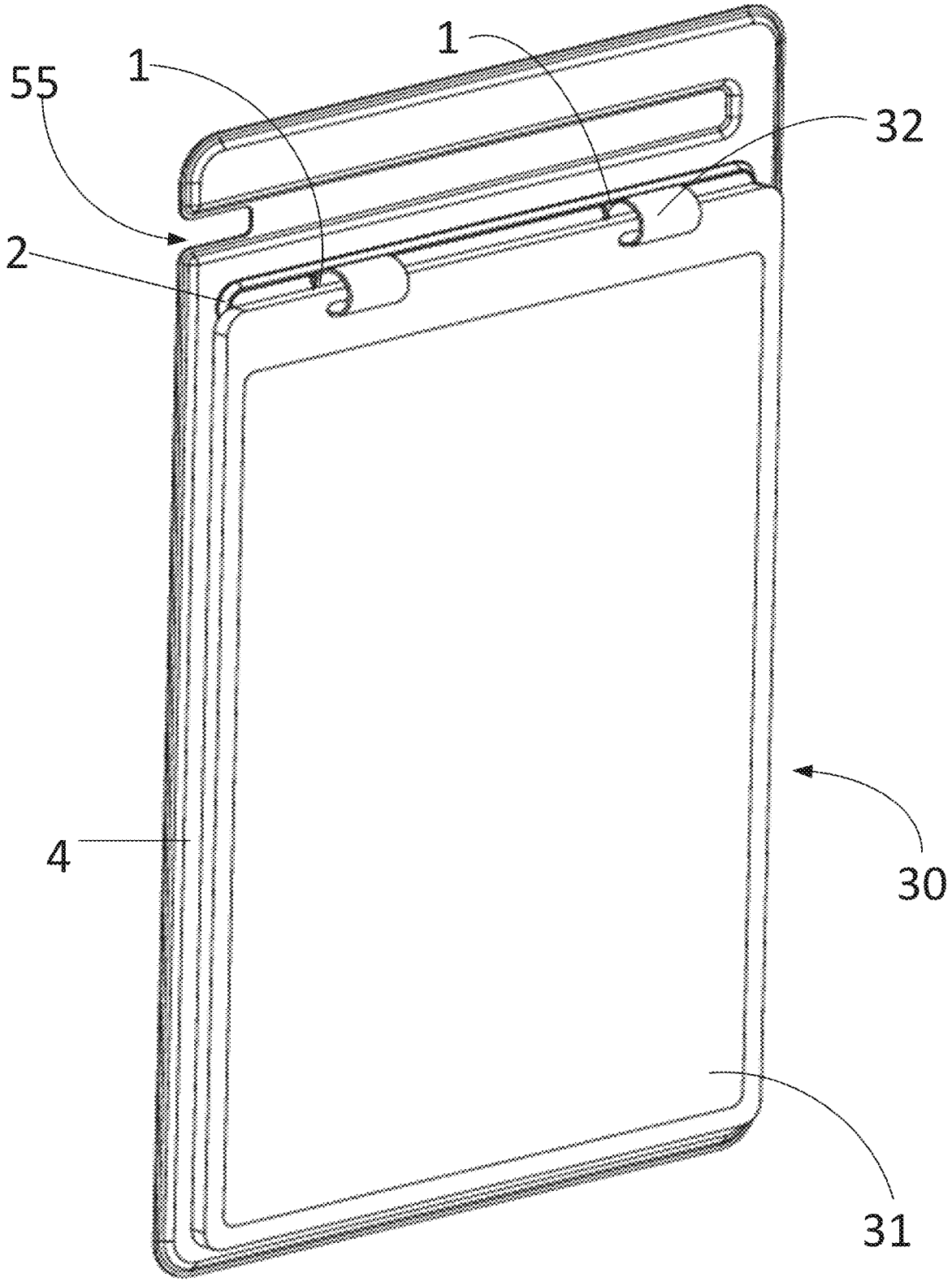
FIG. 20 schematically shows the magnetic spine of FIG. 19 coupled with a page pack and binding elements in accordance with illustrative embodiments of the invention.

FIG. 20 schematically shows the rigid surface 4 of FIG. 19 coupled with the page pack 31 and binding elements 32 in accordance with illustrative embodiments of the invention. The rigid surface 4 may be formed of a multi-layer (e.g., 3-layer) PVC material sandwiched between two layers of polyurethane. In some embodiments, two layers of PVC may partially sandwich the magnetic spine 2 therebetween, thereby retaining the magnetic spine 2.

Figure 21:
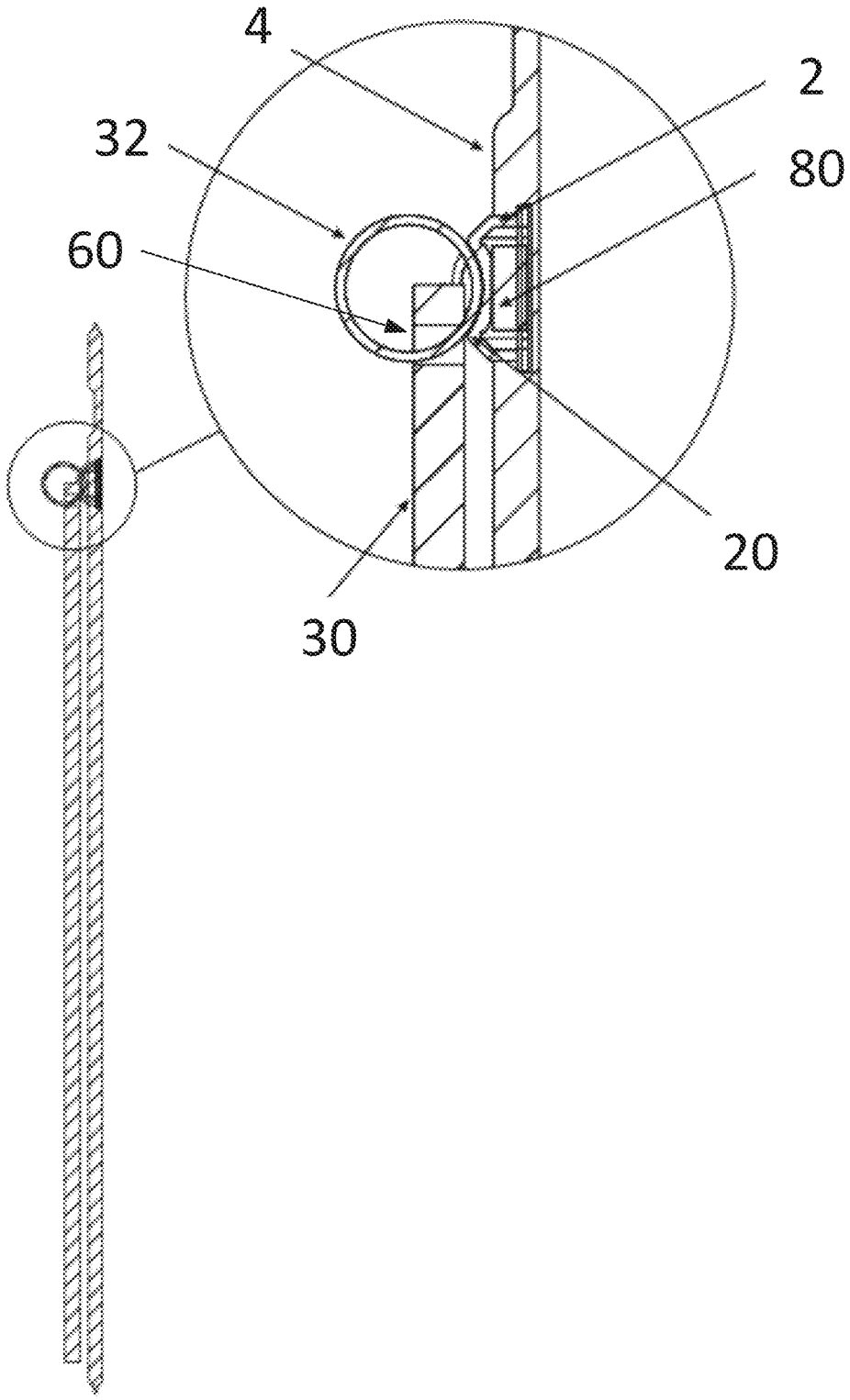
FIG. 21 schematically shows a cross section of FIG. 20.

FIG. 21 schematically shows a cross-section of FIG. 20 through a portion containing the magnetic pad 1. The magnetic pad 1 has the concave surface at the receiving portion 20 that preferably substantially matches the radius of curvature of the binding element 32. In some embodiments, the magnets 80 in the pad 1 may also have a concave surface configured to substantially match the radius of curvature of the binding elements 32.

Figure 22:
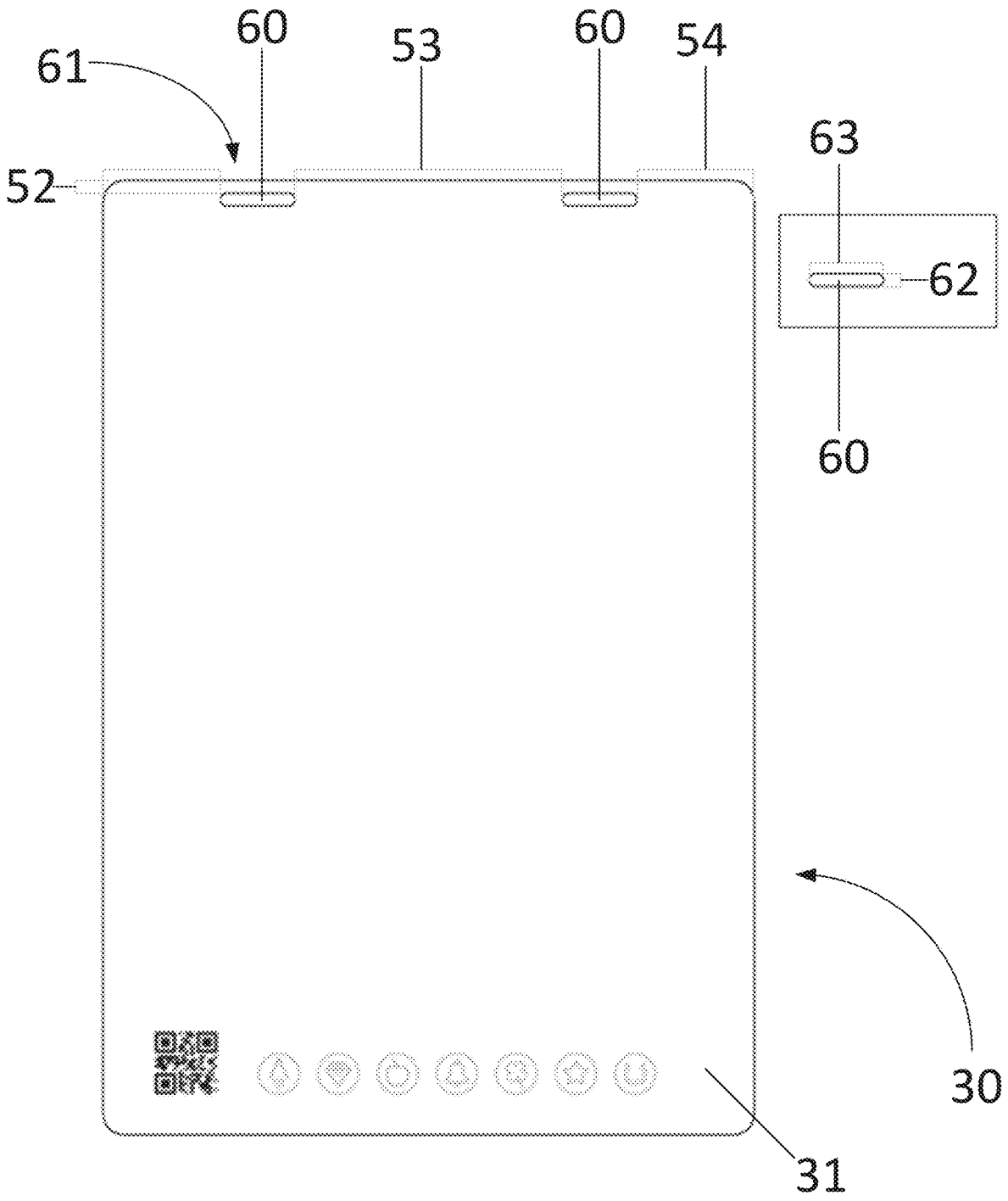
FIG. 22 schematically shows a writing surface as part of a page pack in accordance with illustrative embodiments of the invention.

FIG. 22 schematically shows a writing surface that is configured to be coupled with the binding element 32 in accordance with illustrative embodiments of the invention. The writing surface may be formed from a synthetic paper, such as, Polyart®, Appvion Appleton Digital™, Parax™ stone paper, RockStock™ stone paper, Nekoosa™ XM, Nekoosa™ OM, HopSyn DL Grade®, and/or Yupo® FPG 80. The synthetic-paper page may have a base layer and a surface layer disposed over the base layer. The writing surface may be a synthetic page 31, and/or a different writing surfaces (e.g., synthetic index card).

Synthetic paper generally contains no wood pulp or natural fibers (as found in standard paper), and is commonly formed from polypropylene resin along with inorganic fibers, although many different types of synthetic papers were known (e.g., including different types of synthetic papers referred to as stone paper). Synthetic paper frequently has a base layer covered with a surface layer. Among other things, the base layer of synthetic paper may be formed, for example, polyethylene, polypropylene, high-density polyethylene, polyester, and other plastics. The surface layer adds a bright surface finish, high opacity and smooth texture. Synthetic-paper typically is also more durable than traditional paper.

Many synthetic papers are tear-resistant, wear-resistant, chemical-resistant, heat-resistant, and/or grease-resistant relative to traditional paper. This makes synthetic paper a good option for use in environments where the notebook could be damaged. For example, when used with many traditional pens and markers, notes and/or publications written on synthetic paper may be read in the bath, pool, spa, shower, or while boating, fishing, skiing, snowmobiling or scuba diving.

The writing surface 31 may be a standard size sheet (e.g., 8.5 inch×11 inch) or some non-standardized size. The writing surface 31 may be part of a larger pack (referred to as a page pack 30). Each writing surface 31 may have identical or different pre-printed matter. For example, each writing surface 31 in the pack 30 may have no pre-printed matter (e.g., templates). In some embodiments, each writing surface 31 in the pack 30 may include a pre-defined style template, such as dot-grid, to-do list, calendar, planner content (e.g., from the Panda Planner), college-ruled lines, graph style, Cornell notes, and music staff, among other things. Alternatively, each writing surface 31 may have different pre-printed content and/or templates (e.g., each writing surface 31 corresponds to a different day of the week in a calendar style). Furthermore, one or more pages may include a machine-readable code such as a QR-code/barcode and destination symbols as described in U.S. Pat. No. 10,127,468, incorporated herein by reference in its entirety.

As shown, the writing surface 31 has two binding element 32 slots 60 oriented along a top edge (or side edge, depending on how the page pack 30 is to be coupled). The elongated slots 60 have some distance 52 from a turning edge 61 of the writing surface 31 (e.g., the edge 61 that is to be encompassed within the barrel 35 of the binding element 32, as shown, the top edge). Internal testing for page turning experience indicates that the distance 52 is between about 2 mm to about 1 cm from a turning edge 61 of the page 31. In some embodiments, the elongated slots 60 are positioned 3 mm from the turning edge 61. This provides for convenient flipping of pages 31, as the ring 32 may have a relatively small diameter 38 without catching/snagging on the pages 31.

The elongated slots 60 have a narrow width 62 (e.g., about 3 mm) relative to their length 63 (e.g., about 17.5 mm or greater). The inventors discovered that because synthetic papers are more resilient than traditional paper, a narrow distance 52 between elongated slots 60 and the turning edge 61 could be used to retain binding elements 32 without ripping. Additionally, the weight of the page pack 30 does not necessarily need to be distributed across substantially the entire turning edge 61 of the paper, as with traditional notebooks (e.g., to ensure that the paper does not rip). Accordingly, a distance 53 between elongated slots 60 may be 20 mm, 50 mm, 100 mm or more. For example, in some embodiments, the distance between elongated slots 60 may be about 102.5 mm (e.g., on letter size paper). The tear-resistance of synthetic pages 31 allows for greater distances between elongated slots 60 (e.g., even when compared with 3-ring binder pages) Additionally, the writing surface may have a distance 54 from the slots 60 to a non-turning edge of more than 20 mm (e.g., about 38 mm). Accordingly, smaller and/or fewer binding elements 32 may be used to retain the page pack 30 (or other writing surface), advantageously reducing supply and manufacturing costs, as well as providing more usable writing surface.

Accordingly, illustrative embodiments may use elongated slots 60 that are longer than the holes in traditional paper notebooks (e.g., wire-o spiral bound paper notebooks and/or three-hole punched). To help keep a pull force of the magnets 80 high enough to retain the page packs 30, preferably binding elements 32 that are 15 mm or longer are used. Accordingly, the elongated slot 60 has a length 63 that is greater than three times the width 62, preferably greater than five times the width 62, and in some embodiments greater than ten times the width 62.

As described and shown previously, each elongated slot 60 is configured to receive the binding element 32, which in turn couples with the magnets 80 in the rigid surface 4 (e.g., notebook cover). The note-taking system is preferably configured (e.g., the size of the slots 60, the binding elements 32, and the size and strength of the magnets 80) to a total pull force of 3 lbs. or greater to uncouple the binding elements 32 from the magnets 80. In illustrative embodiments, the note taking system is configured such that the pull force required to uncouple the binding element 32 from the magnetic pad 1 is between about 3 lbs. and about 5 lbs., more preferably between about 3.75 lbs. and about 4.5 lbs. The pull force strength enables the magnetic force of the binding elements 32 to retain the page pack 30 during normal use while reducing likelihood of accidental dislodgement, and simultaneously providing for ease of intentional removal. Preferably, the system is configured such that the uncoupling is non-destructive (e.g., the binding elements 32 and/or the writing surfaces 31 are not destroyed during the uncoupling). This is opposed to prior art three-ring binder systems, for example, where pulling with sufficient strength tears the pages and/or the cover, or destroys the rings.

Based on the present disclosure, a person of ordinary skill in the art will understand that illustrative embodiments provide a number of advantages. For example, the modular notebook system allows users to design, change and upgrade their own notebook from a fixed set of components. From the manufacturer perspective, the need to design, test and sell notebook components to maximize market reach without manufacturing the multitude of permutations without knowing at what rate each will sell is substantially reduced. Another advantage is that the pages and the cover of the notebook are interchangeable and can be reconfigured by the user based on the task (or environment) at hand. Further advantages of illustrative embodiments include that manufacturers can design, manufacture and sell different interchangeable notebook covers and pages thereby satisfying a wide variety of consumer without manufacturing an impossibly huge amount of inventory.

Additional advantages disclosed herein include more usable writing surface because of positioning of slots 60 on writing surface 31 (e.g., creating a small distance 52 and a larger distance 53 and 54). Furthermore, by using elongated slots 60, larger binding elements 32 may be used, providing for robust magnetic coupling with magnets 80.

Disclosed embodiments, or portions thereof, may be combined in ways not listed above and/or not explicitly claimed. In addition, embodiments disclosed herein may be suitably practiced, absent any element that is not specifically disclosed herein. Accordingly, the invention should not be viewed as being limited to the disclosed embodiments.

It should be further understood that discussion of a notebook and/or note taking system is used for convenience. Alternative embodiments may have forms different than a traditional notebook form. Furthermore, drawings, musical notes, and other markings are considered to be "notes" within the description of illustrative embodiments, and are not limited to alphanumeric-style notes.

Figure 23:
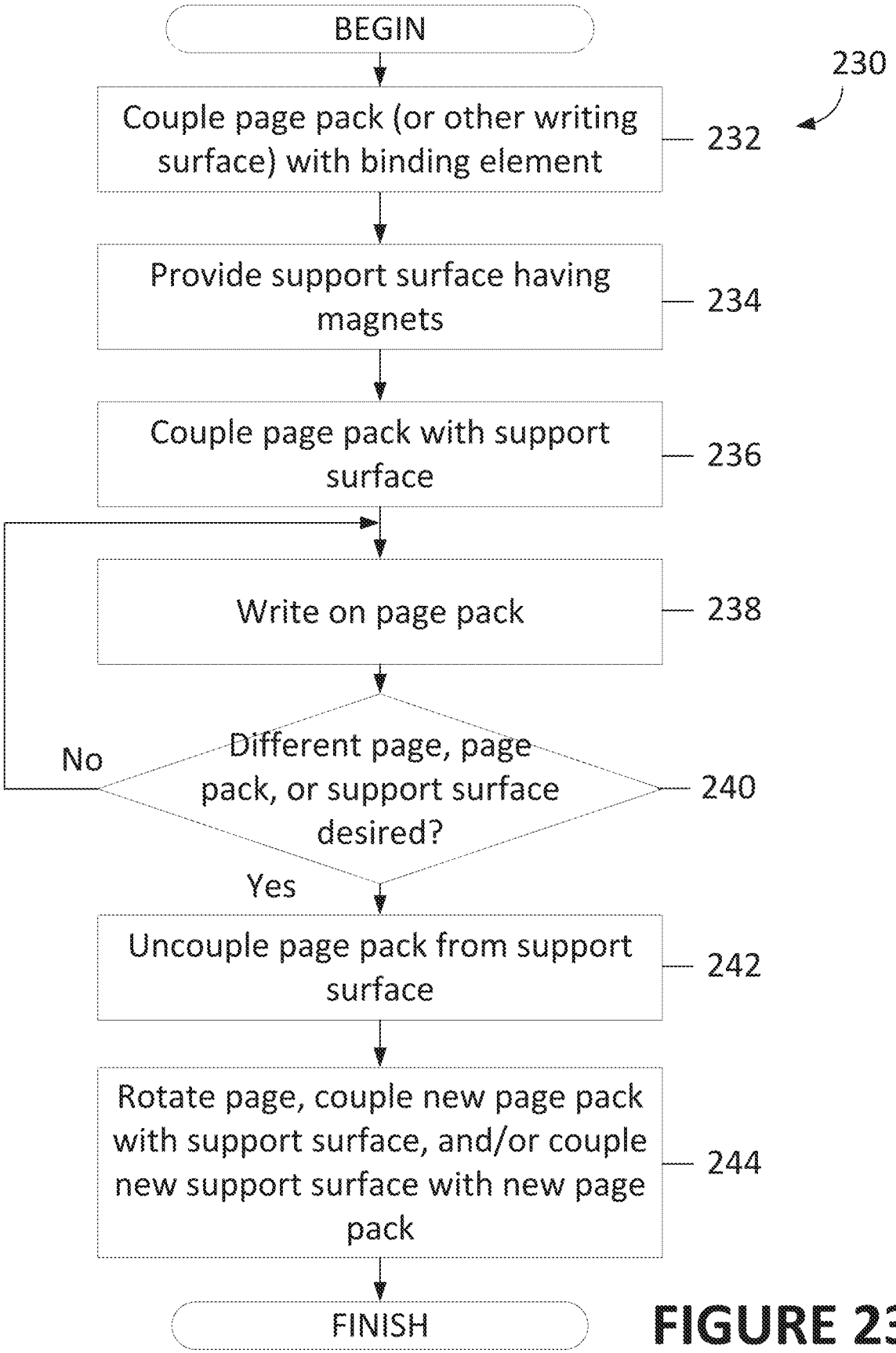
FIG. 23 shows a process of using the modular note taking system in accordance with illustrative embodiments of the invention.

FIG. 23 shows a process 230 of using the modular note taking system in accordance with illustrative embodiments of the invention. This process is substantially simplified from a longer process that normally would be used. Accordingly, the process may have many steps that those skilled in the art likely would use. In addition, some of the steps may be performed in a different order than that shown, or at the same time. Those skilled in the art therefore can modify the process as appropriate.

The process begins at step 232, where the page pack 30 (or other writing surface 31) is coupled with the binding element 32. As discussed previously, the binding element 32 may be coupled with the writing surface 31 by closing the binding element 32 through the elongated slot 60 and encompassing at least a portion of a turning edge 61 of the writing surface 31. To that end, the binding element 32 may begin in a substantially planar configuration (e.g., shown in FIG. 3C), and may be bent into a substantially cylindrical configuration through the elongated slot 60. The page pack may be provided as a kit with the binding element 32 already coupled with the writing surfaces 31, for example, in the above-described manner. The initially chosen page pack may optionally include a pre-printed template thereon.

The process then proceeds to step 234, which provides a support surface 4 having magnets 80. The magnets 80 may be embedded in the support surface 4. Additionally, or alternatively, the support surface 4 may include one or more magnetic pads 2 configured to receive the binding element 32.

The support surface 4 may be chosen from a variety of support surfaces 4. For example, the support surface 4 may be part of a notebook cover. Accordingly, as described herein, the user may choose from a variety of different sizes, shapes, and materials for the support surface 4. Furthermore, the page pack 30 may be picked from a variety of different sizes, paper types, and/or pre-printed templates. For example, the user may wish to couple a dot-grid page pack with a corresponding blue rigid support surface 4. Additionally, the support surface 4 may include the pen dock 55.

At step 236, the page pack 30 is coupled with the support surface 4 (e.g., as shown in FIG. 9). In illustrative embodiments, the magnetically attractive binding element 32 is positioned into the magnetic pad 1, which receives the binding element 32. The magnetic force couples the binding element 32 with the magnets 80, thereby coupling the page pack 30 with the support surface 4. Additionally, or alternatively, hooks 1185 and/or blocks 1184 may be used to assist with coupling the page pack 30 with the support surface 4.

At step 238, the user may use the modular note taking system by writing on the writing surface. In illustrative embodiments, the user may write on synthetic pages 31 with a Pilot FriXion pen, thereby enabling easy erasure via a damp cloth.

At step 240, the user can decide whether to use a different page (e.g., from the page pack), a different page pack, or a different support surface. If not, the process returns to step 328. If yes, the process proceeds to step 242.

At step 242, the user uncouples the page pack 30 from the support surface 4. This can be accomplished by pulling the binding elements 32 and/or the page pack 30 away from the rigid surface 4 and/or magnetic pads 1. In some embodiments, the binding element 32 is tilted to dislodge from the hooks 1185 and/or blocks 1184. As described previously, the magnetic attraction between binding elements 32 and magnetic pads 1 requires sufficient force to overcome. After the user applies the required force, the page pack 30 is uncoupled from the support surface 4.

At step 244, the user has a number of options. For example, the front page of the pack 30 can be rotated so as to become the last page in the pack. This is particularly advantageous in embodiments that have a turning edge 61 on top, where generally a single page is viewed at a time. After the user writes on the page, they may wish to write on the next page (e.g., in a calendar template style). After the page is rotated, the page pack 30 is recoupled with the surface 4.

Another option is to couple a new page pack 30 with the support surface 4. For example, the user may wish to switch from a calendar template page pack 30 to a dot-grid page pack 30. The user may recouple the new page pack 30 with the surface 4 as described above with reference to step 236. Alternatively, the user may wish to change the support surface 4. For example, the user may wish to change the style or type of cover. Again, the user may recouple the new page pack 30 with the surface 4 as described above with reference to step 236. The process then comes to an end.

Although illustrative embodiments refer to coupling the page pack 30 with the support surface 4, it should be understood that illustrative embodiments do not need to directly couple with support surface 4. Such discussion was merely for illustrative purposes, and is not intended to limit various embodiments of the invention. Furthermore, it should be understood that in the process 230, page packs 30 may also be substituted by other collections of writing surfaces 31 (e.g., index cards).

The embodiments of the invention described above are intended to be merely exemplary; numerous variations and modifications will be apparent to those skilled in the art. Such variations and modifications are intended to be within the scope of the present invention as defined by any of the appended claims.

Various embodiments of the present invention may be characterized by the potential claims listed in the paragraphs following this paragraph (and before the actual claims provided at the end of the application). These potential claims form a part of the written description of the application. Accordingly, subject matter of the following potential claims may be presented as actual claims in later proceedings involving this application or any application claiming priority based on this application. Inclusion of such potential claims should not be construed to mean that the actual claims do not cover the subject matter of the potential claims. Thus, a decision to not present these potential claims in later proceedings should not be construed as a donation of the subject matter to the public. Nor are these potential claims intended to limit various pursued claims.

Without limitation, potential subject matter that may be claimed (prefaced with the letter "P" so as to avoid confusion with the actual claims presented below) includes:

Potential Claims:

P1. A modular notebook system comprising:

a cover having a plurality of surfaces; and a binding coupled to the plurality of surfaces via a flexible and/or foldable material, the binding forming a magnetic spine by having at least one magnetic pad configured to receive a magnetically attractive binding element.

P2. The modular notebook system of claim P1, further comprising:

a magnetically attractive binding element configured to couple with a page pack.

P3. The modular notebook system of claim P2, wherein the magnetically attractive binding element is deformable from a first substantially planar orientation to a second substantially cylindrical orientation.

P4. The modular notebook system of claim P3, wherein the binding element is coupled to the page pack after it transitions to the second substantially cylindrical orientation.

P5. The modular notebook system of claim P3, wherein substantially cylindrical orientation forms a substantially closed cylinder, such a seam in the cylinder is sufficiently small to pages from the page pack from accidentally being uncoupled from the binding element.

P6. The modular notebook system of claim P1, further comprising a plurality of magnetic pads.

P7. The modular notebook system of claim P1, wherein the cover has an open configuration and a closed configuration, the notebook being configured so that the surfaces of the cover and the binding lay substantially flat in the open configuration.

P8. The modular notebook system of claim P1, wherein the cover has an open configuration and a closed configuration, the notebook being configured so that at least one of the surfaces of the cover and the binding lay substantially flat in the closed configuration.

P9. The modular notebook system of claim P1, further comprising a page pack having an opening to receive the binding element.

P10. The modular notebook system of claim P9, wherein pages in the page pack are college ruled and/or graph paper.

P11. The modular notebook system of claim P1, wherein the surfaces of the cover are rigid.

P12. The modular notebook system of claim P1, wherein the magnetic pad has a contoured receiving surface.

P13. The modular notebook system of claim P1, wherein the magnetic pad is flush with the spine.

P14. The modular notebook system of claim P1, wherein the magnetic pad has an outer wall.

P15. The modular notebook system of claim P1, wherein the magnetic pad is recessed into the spine.

P16. The modular notebook system of claim P1, wherein the magnetic pad protrudes from the spine.

P17. A modular note taking system comprising:

a support surface configured to support a plurality of writing surfaces;

at least one binding element configured to retain the plurality of writing surfaces;

a pad coupled with the support surface, the pad having a retainment member configured to couple with the at least one binding element to removably couple the writing surfaces with the support surface.

P18. The modular note taking system of claim P17, wherein the pad is a magnetic pad.

P19. The modular note taking system of claim P17, wherein the pad has a hook configured to be positioned within a barrel of the binding element.

P20. The modular note taking system of claim P17, wherein the pad has a ramp on which the binding element is configured to slide.

P21. The modular note taking system of claim P17, wherein the pad has a bump against which the binding element rests.

P22. The modular note taking system of claim P17, wherein the support surface is rigid.

P23. The modular note taking system of claim P17, wherein the support surface is part of a cover of a notebook.

P24. The modular note taking system of claim P17, wherein the binding element is metallic.

P25. The modular note taking system of claim P17, wherein the pad is integral to the support surface.

P26. The modular note taking system of claim P17, wherein the pad is attached to the support surface via an adhesive.

P27. The modular note taking system of claim P17, wherein the pad is oriented horizontally relative to a longitudinal axis of the page.

P28. The modular note taking system of claim P17, wherein the binding element has a seam with a notch or a seam that forms a V-shape.

P29. The modular note taking system of claim P17, wherein the coupling the at least one binding element and the pad is sufficiently strong to withstand the weight of the page pack without being removed from the pad.

P30. A magnetically coupled note taking system, the system comprising:

a support surface coupled with at least one magnet;

a writing surface having a slot for receiving a magnetically attractive binding element;

a magnetically attractive binding element configured to couple with the slot to retain the writing surface.

P31. The magnetically coupled note taking system of claim P30, wherein the support surface includes a pen dock.

P32. The magnetically coupled note taking system of claim P30, wherein the slot is an elongated slot.

P33. The magnetically coupled note taking system of claim P30, wherein the slot has a length greater than 5 times the width of the slot.

P34. The magnetically coupled note taking system of claim P30, wherein the system is configured to non-destructively uncouple the one or more binding elements from the one or more magnets with a pull force of between 3 lbs. and 10 lbs.

P35. The magnetically coupled note taking system of claim P30, wherein the writing surface is a synthetic page.

P36. A writing surface pack comprising:

a plurality of writing surfaces configured to be written on with a writing instrument, the plurality of writing surfaces each having a turning edge and an elongated slot configured to receive a magnetically attractive binding element that encompasses at least a portion of the turning edge; and a magnetically attractive binding element configured to retain the plurality of writing surfaces by passing through the elongated slot and encompassing at least a portion of the turning edge.

P37. The pack of claim P36, wherein the writing surfaces form a page pack.

P38. The pack of claim P36, wherein the elongated slot has a length of between about 10 mm and 120 mm.

P39. The pack of claim P36, wherein the elongated slot has a length greater than 5 times the width of the elongated slot.

P40. The pack of claim P36, wherein the writing surfaces each include two slots.

P41. The pack of claim P40, wherein a distance between the two slots is greater than 20 mm.

P42. The pack of claim P36, wherein the elongated slots have a width of about 3 mm.

P43. The pack of claim P36, wherein the binding element has a thickness of less than 1 mm.

P44. The pack of claim P36, wherein the binding element has a length of between about 10 mm and 120 mm.

P45. The pack of claim P36, wherein the writing surfaces come with a dot-grid template.

P46. The pack of claim P36, further comprising a support surface containing magnets configured to magnetically couple with the binding element.

P47. The pack of claim P46, wherein the support surface has a magnetic pad with a curved retaining surface.

P48. The pack of claim P47, wherein the retaining surface has a radius of curvature configured to substantially match a radius of curvature of the binding element.

What is claimed is:

1. A modular note taking system comprising:

a cover having a plurality of surfaces;

a magnetic spine having at least one magnetic pad, the at least one magnetic pad having at least one magnet and a concave receiving surface;

a plurality of writing surfaces having an elongated opening extending through a thickness of the writing surfaces; and a magnetically attractive binding element that retains the plurality of writing surfaces by passing through the elongated opening extending through the thickness of the writing surfaces; the concave receiving surface configured to receive the magnetically attractive binding element.

2. The modular note taking system of claim 1, further comprising a plurality of magnetic pads.

3. The modular note taking system of claim 1, wherein the binding element forms a hollow cylinder.

4. The modular note taking system of claim 1, wherein the magnetic pad has an outer wall protruding beyond the concave receiving surface.

5. The modular note taking system of claim 1, wherein the support surface includes a pen dock.

6. The modular note taking system of claim 1, wherein the elongated slot has a length greater than 5 times the width of the slot.

7. The modular note taking system of claim 1, wherein the elongated slot has a length of between about 10 mm and 120 mm.

8. The modular note taking system of claim 1, further comprising a plurality of magnetically attractive binding elements.

9. The modular note taking system of claim 8, wherein the one or more magnetically attractive binding elements are non-destructively uncoupled from magnetic pad with a pull force of between 3 lbs. and 10 lbs.

10. The modular note taking system of claim 1, wherein the plurality of writing surfaces are synthetic pages.

11. The modular note taking system of claim 1, wherein the binding element has a length of between about 10 mm and 120 mm.

12. The modular note taking system of claim 1, wherein the plurality of writing surfaces each have a turning edge, and the elongated slot is configured to receive the magnetically attractive binding element so that the magnetically attractive binding element encompasses at least a portion of the turning edge.

13. The modular note taking system of claim 12, wherein each of the writing surfaces include two elongated slots.

14. The modular note taking system of claim 12, wherein a distance between the two elongated slots is greater than 20 mm.

15. The modular note taking system of claim 1, wherein each of the writing surfaces is separable from each of the other writing surfaces when the plurality of writing surfaces are coupled with the binding element.

16. The modular note taking system of claim 1, wherein each of the plurality of writing surfaces has the elongated slots about 2 mm to about 1 cm from a turning edge.

17. The modular note taking system of claim 1, wherein the binding element retains the writing surfaces by circumscribing a portion of the turning edge.

18. The modular note taking system of claim 1, wherein the pad has a hook configured to be positioned within a barrel of the binding element.

19. A modular note taking system comprising:

a support surface configured to support a plurality of writing surfaces;

a binding element configured to couple with a plurality of writing surfaces, wherein an order of the writing surfaces in the plurality of writing surfaces is changeable when the plurality of writing surfaces are coupled with the magnetically attractive binding element;

a magnet coupled with the support surface, the magnet being positioned within a pad coupled to the support surface, the magnet configured to retain the binding element in a receiving portion of the pad to removably couple the writing surfaces with the support surface, wherein the plurality of writing surfaces comprise a plurality of pages coupled with the binding element, and changing the order of the writing surfaces comprises making a front page of the plurality of pages become a back page of the plurality of pages without uncoupling the plurality of pages from the binding element.

20. The modular note taking system of claim 19, wherein the binding element has a convex surface.

21. The modular note taking system of claim 20, wherein the pad has a hook configured to be positioned within a barrel of the binding element.

22. The modular note taking system of claim 19, wherein the support surface includes a pen dock.

23. The modular note taking system of claim 19, wherein the receiving portion has a concave shape.

24. The modular note taking system of claim 19, wherein the magnetic pad has an outer wall protruding beyond the receiving surface.

25. The modular note taking system of claim 19, wherein the plurality of writing surfaces are synthetic pages.

* * * * *